US009950229B2

(12) United States Patent
Lee et al.

(10) Patent No.: US 9,950,229 B2
(45) Date of Patent: Apr. 24, 2018

(54) GOLF CLUB HEAD COVER

(71) Applicant: Karsten Manufacturing Corporation, Phoenix, AZ (US)

(72) Inventors: Daniel K. Lee, Phoenix, AZ (US); Brian McGuire, Phoenix, AZ (US); James Chen, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 14/945,224

(22) Filed: Nov. 18, 2015

(65) Prior Publication Data

US 2016/0144253 A1 May 26, 2016

Related U.S. Application Data

(60) Provisional application No. 62/108,447, filed on Jan. 27, 2015, provisional application No. 62/084,641, filed on Nov. 26, 2014.

(51) Int. Cl.
*A63B 60/62* (2015.01)

(52) U.S. Cl.
CPC ..... *A63B 60/62* (2015.10)

(58) Field of Classification Search
CPC ..... A63B 60/62
USPC ..... 150/160
See application file for complete search history.

(56) References Cited

U.S. PATENT DOCUMENTS

| | | | | | |
|---|---|---|---|---|---|
| 2,035,529 | A | | 3/1936 | Bucklin | |
| D131,372 | S | | 2/1942 | Reed et al. | |
| D131,383 | S | | 2/1942 | Thelander | |
| 2,526,985 | A | * | 10/1950 | Whitehead | A63B 60/62 150/160 |
| 2,532,195 | A | * | 11/1950 | Rosenow | A63B 60/62 150/160 |
| 2,737,394 | A | * | 3/1956 | Abel | A63B 60/62 150/160 |
| D202,199 | S | | 9/1965 | Bates | |
| 3,253,628 | A | * | 5/1966 | Koetting | A63B 60/62 150/160 |
| 3,548,908 | A | * | 12/1970 | Koetting | A63B 60/62 150/160 |
| 3,821,976 | A | | 7/1974 | Smith | |
| 4,667,716 | A | | 5/1987 | Solheim | |
| 5,168,909 | A | | 12/1992 | Joyner | |
| 5,295,268 | A | | 3/1994 | Pociask | |
| 5,345,987 | A | | 9/1994 | Hagar | |
| 5,403,009 | A | | 4/1995 | Gleason, Jr. | |
| D374,051 | S | | 9/1996 | Sheppard, Jr. | |

(Continued)

FOREIGN PATENT DOCUMENTS

| | | | | |
|---|---|---|---|---|
| GB | 2350304 A | * | 11/2000 | A63B 60/62 |
| JP | 2009273748 A | * | 11/2009 | |

(Continued)

*Primary Examiner* — Sue A Weaver

(57) ABSTRACT

A golf club head cover including a head portion that defines a compartment that receives a golf club head and a sleeve portion that extends from the head portion and defines a sleeve conduit having an open end. The sleeve conduit is in communication with the compartment and the open end is positioned opposite the compartment. The sleeve portion is constructed from a first material and a second material. The second material is more elastic than the first material.

8 Claims, 27 Drawing Sheets

(56) References Cited

U.S. PATENT DOCUMENTS

| | | | | | |
|---|---|---|---|---|---|
| 5,769,141 | A * | 6/1998 | Rinehard | A63B 60/62 150/160 |
| RE35,899 | E * | 9/1998 | Cirone | A63B 60/62 150/160 |
| D421,780 | S | 3/2000 | Whitesides | |
| 6,065,016 | A * | 5/2000 | Stuntebeck | H04M 3/4931 |
| D431,062 | S | 9/2000 | Besnard | |
| D432,193 | S | 10/2000 | Bradshaw | |
| D445,864 | S | 7/2001 | McLoughlin | |
| D447,202 | S | 8/2001 | Besnard | |
| 6,321,805 | B1 | 11/2001 | Suggs | |
| 6,820,665 | B2 | 11/2004 | Bradshaw | |
| D512,115 | S | 11/2005 | Chen | |
| D528,618 | S | 9/2006 | Chen | |
| D540,899 | S | 4/2007 | Chen | |
| D552,200 | S | 10/2007 | Chen | |
| D561,857 | S | 2/2008 | Noyes | |
| D575,839 | S | 8/2008 | Quartarone, III | |
| D576,237 | S | 9/2008 | Chen | |
| D576,696 | S | 9/2008 | Chen | |
| D585,512 | S | 1/2009 | Quartarone, III | |
| D590,464 | S | 4/2009 | Chen | |
| D590,901 | S | 4/2009 | Chen | |
| D596,253 | S | 7/2009 | Chen | |
| 7,597,126 | B2 | 10/2009 | Chen | |
| D603,473 | S | 11/2009 | Templeton | |
| D605,716 | S | 12/2009 | Cameron | |
| D606,604 | S | 12/2009 | Norris | |
| 7,686,047 | B2 | 3/2010 | Hooley | |
| 7,686,048 | B1 | 3/2010 | Bradshaw | |
| D616,514 | S | 5/2010 | Quartarone, III | |
| D616,515 | S | 5/2010 | Quartarone, III | |
| 7,857,023 | B2 | 12/2010 | Hooley | |
| D631,112 | S | 1/2011 | Chen | |
| D650,027 | S | 12/2011 | Gaffney | |
| D652,096 | S | 1/2012 | Chen | |
| D652,466 | S | 1/2012 | Chen | |
| D675,270 | S | 1/2013 | Loudenslager | |
| D676,511 | S | 2/2013 | Chen | |
| D691,228 | S | 10/2013 | Chen | |
| D698,404 | S | 1/2014 | Cameron | |
| 8,800,614 | B2 * | 8/2014 | Loudenslager | A63B 55/007 150/154 |
| D719,229 | S | 12/2014 | Lee et al. | |
| D720,822 | S | 1/2015 | Lee | |
| D737,914 | S | 9/2015 | Cameron | |
| 2003/0056866 | A1 | 3/2003 | Sheppard, Jr. | |
| 2003/0121808 | A1 * | 7/2003 | Maeng | A63B 60/62 206/315.2 |
| 2008/0105343 | A1 | 5/2008 | Noyes | |
| 2009/0008008 | A1 * | 1/2009 | Kuo | A63B 47/005 150/160 |
| 2009/0032154 | A1 | 2/2009 | Quartarone, III | |
| 2011/0056600 | A1 | 3/2011 | Hooley | |
| 2012/0125497 | A1 * | 5/2012 | Gaffney | A63B 55/007 150/160 |
| 2012/0255659 | A1 | 10/2012 | Loudenslager | |
| 2015/0047761 | A1 | 2/2015 | Higdon et al. | |

FOREIGN PATENT DOCUMENTS

| | | | | |
|---|---|---|---|---|
| JP | 2013106696 A * | 6/2013 | | |
| WO | WO 2006006258 A1 * | 1/2006 | | A63B 60/62 |

* cited by examiner

GOLF CLUB HEAD COVER

CROSS-REFERENCE TO RELATED APPLICATIONS

This claims priority to U.S. Provisional Patent Application No. 62/084,641, filed Nov. 26, 2014, and U.S. Provisional Patent Application No. 62/108,447, filed on Jan. 27, 2015. The contents of the disclosures listed above are incorporated herein by reference in their entirety.

BACKGROUND

The present disclosure relates to club head covers, and in particular to club head covers having a handle for removal of the golf club head cover from a golf club head.

Proper care of golf clubs is required both to maximize their usable life and to maintain their performance. An important aspect of proper care includes protecting golf club heads from damage due to impact with other golf club heads or exposure to environmental elements when the clubs are not in use. As such, club head covers are widely used for many types of golf clubs, such as putters and wood-type golf clubs. Many existing club head covers are typically removed by gripping them anywhere the individual is able to grasp the club head cover, which usually involves trying to pinch or squeeze excess material of the club head cover to remove it from the golf club head; however such a technique can be cumbersome. Although there are club head covers having a strap to assist in removing the golf club head, such straps are thin and of constant width which can be difficult for the individual to conveniently grasp or handle to efficiently remove the club head cover. In addition, the force required to be applied to such thin straps to remove the club head cover from the golf club head, which have increased in volume in recent years, can also lead to the material of the club head cover being overly stretched and elongated after repeated removal. This action can also bend and apply stress to the shaft of the golf club as the individual attempts to remove the club head cover from the golf club head. Moreover, thin pull straps may also become damaged over time due to constant use that can produce stress points, which can cause the pull strap to break over time.

Figure 1:
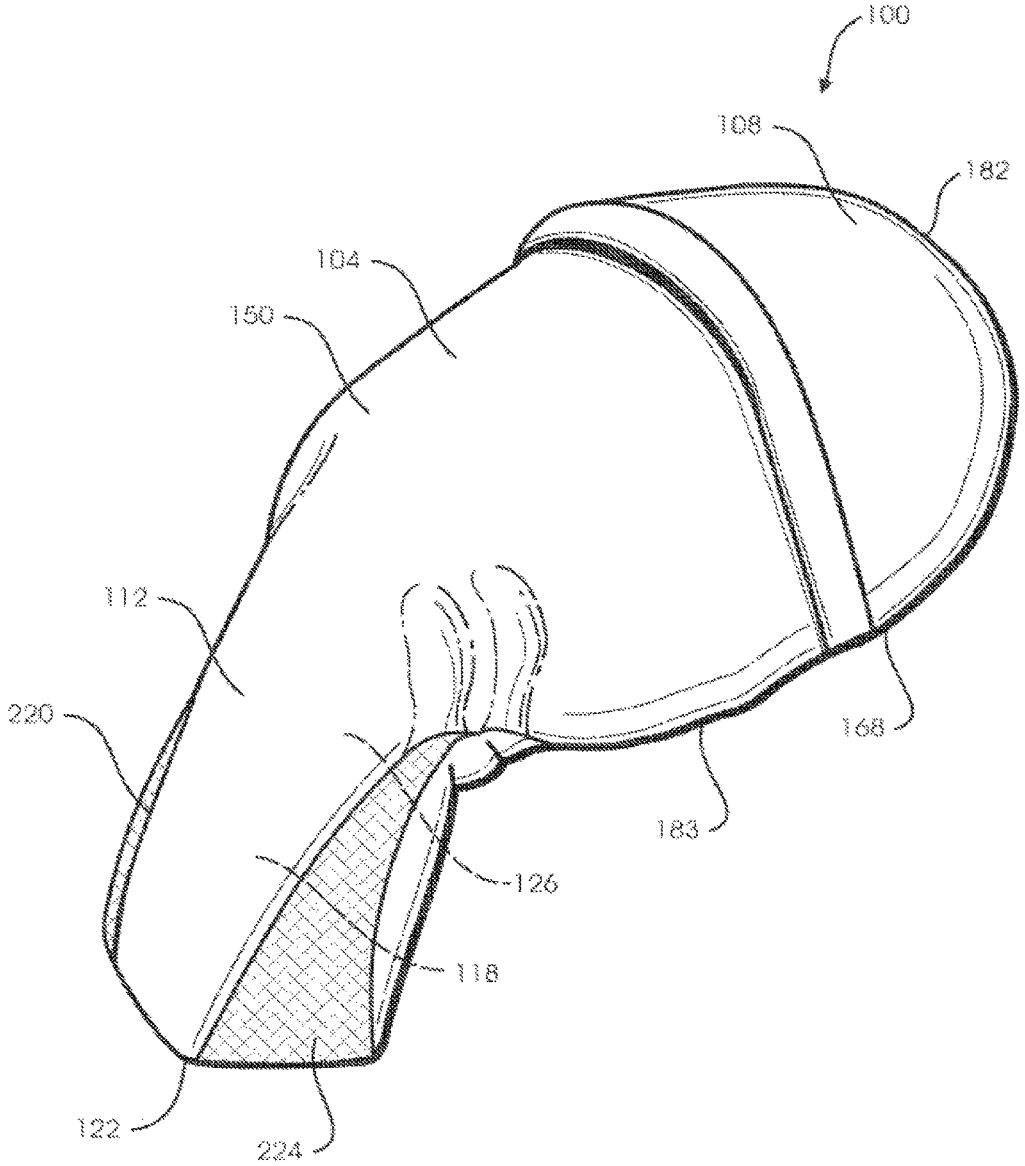
FIG. 1 is a front side perspective view of a golf club head cover according to a first embodiment of the invention.

Other aspects of the invention will become apparent by consideration of the detailed description and accompanying drawings.

DETAILED DESCRIPTION

Various embodiments of golf club head covers include a head portion defining a compartment that receives a golf club head and a sleeve portion extending from the head portion and defining a sleeve conduit having an open end, the sleeve conduit being in communication with the compartment, the open end being positioned opposite the compartment, the sleeve portion being constructed from a first material and a second material, the second material being more elastic than the first material. In some embodiments, the compartment is constructed from the first material. The open end is substantially rectangularly-shaped or substantially ovular. The sleeve portion and the compartment define a passageway that is configured to receive a golf club head therethrough. The compartment is selectively expandable and the sleeve portion is selectively expandable, the sleeve portion being expandable independently of the compartment. A narrowed region is configured to selectively expand the passageway. In some embodiments, the golf club head cover further includes a top surface having an arcuately-shaped portion extending between a first side and a second side, a bottom surface having an arcuately-shaped portion extending between a first side and a second side, the arcuately-shaped portion of the bottom surface coupled to the arcuately-shaped portion of the top surface, the top surface and the bottom surface at least partially defining the head portion, a first elastic member extending between the first side of the top surface and the second side of the bottom surface, and a second elastic member extending between the second side of the top surface and the first side of the bottom surface, the first and the second elastic members defining a portion of the sleeve portion, wherein the top surface, the bottom surface, the first elastic member, and the second elastic member define the open end. In some embodiments, the golf club head cover further includes a handle coupled to the top surface, the handle formed as a pocket that has an opening that faces in a substantially downwardly-opening direction toward the open end.

Other embodiments of golf club head covers include a body including a head portion that defines a compartment and a sleeve portion extending from the head portion and defining a sleeve conduit having an open end being positioned opposite the compartment, the body including a top surface including a substantially arcuately-shaped portion extending between a first side and a second side, a bottom surface including a substantially arcuately-shaped portion extending between a first side and a second side, the arcuately-shaped portion of the bottom surface being coupled to the arcuately-shaped portion of the top surface, the top surface and the bottom surface at least partially defining the head portion, and an elastic member defining at least a portion of the sleeve portion. In some embodiments, the top surface and the bottom surface are constructed from a first material that is less elastic than the elastic member. The top surface, the bottom surface, and the elastic member define the open end. The open end is substantially rectangularly-shaped or substantially ovular. The sleeve portion and the compartment define a passageway that is configured to receive a golf club head therethrough. The compartment is selectively expandable and the sleeve portion is selectively expandable, the sleeve portion being expandable independently of the compartment. A narrowed region is configured to selectively expand the passageway. The golf club head cover may further include a handle coupled to the top surface, the handle formed as a pocket that has an opening that faces in a substantially downwardly-opening direction toward the open end.

Other embodiments of golf club head covers include a body having a top surface, a bottom surf ace coupled to the top surface, the top surface and the bottom surface defining a compartment, a first elastic member extending between the top surface and the bottom surface, a second elastic member extending between the top surface and the bottom surface, the first and the second elastic members defining at least a portion of a sleeve portion, the sleeve portion in communication with the compartment and having an open end at an end opposite the compartment, and a narrowed region coupled between the first elastic member and the second elastic member, the narrowed region configured to selectively expand the sleeve portion. In some embodiments, the compartment is selectively expandable and the sleeve portion is selectively expandable, the sleeve portion being expandable independently of the compartment. The top surface, the bottom surface, the first elastic member and the second elastic member define the open end. The open end is substantially rectangularly-shaped or substantially ovular. The golf club head cover may further include a handle coupled to the top surface, the handle formed as a pocket that has an opening that faces in a substantially downwardly-opening direction toward the open end.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 10:
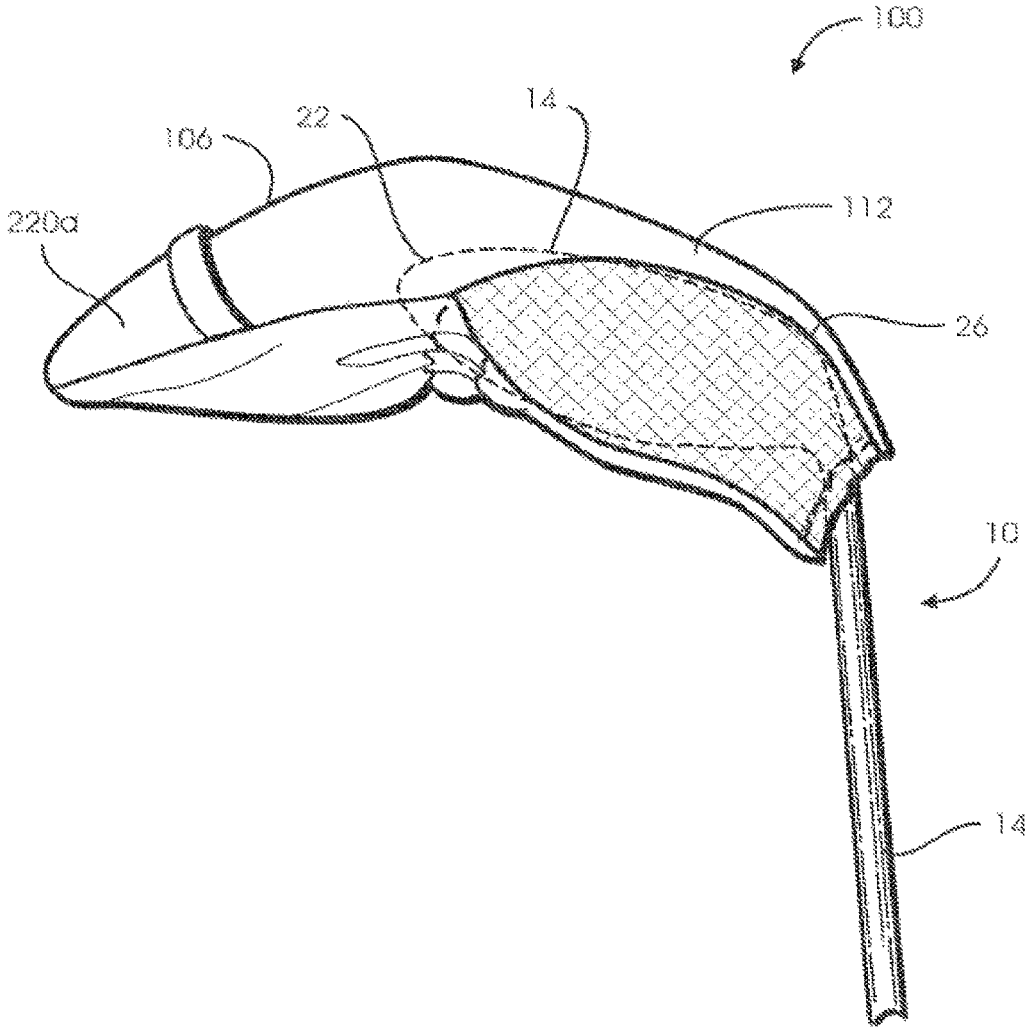
FIG. 10 is a side view of the golf club head cover of FIG. 1 with a golf club head inserted therein.
Figure 11:
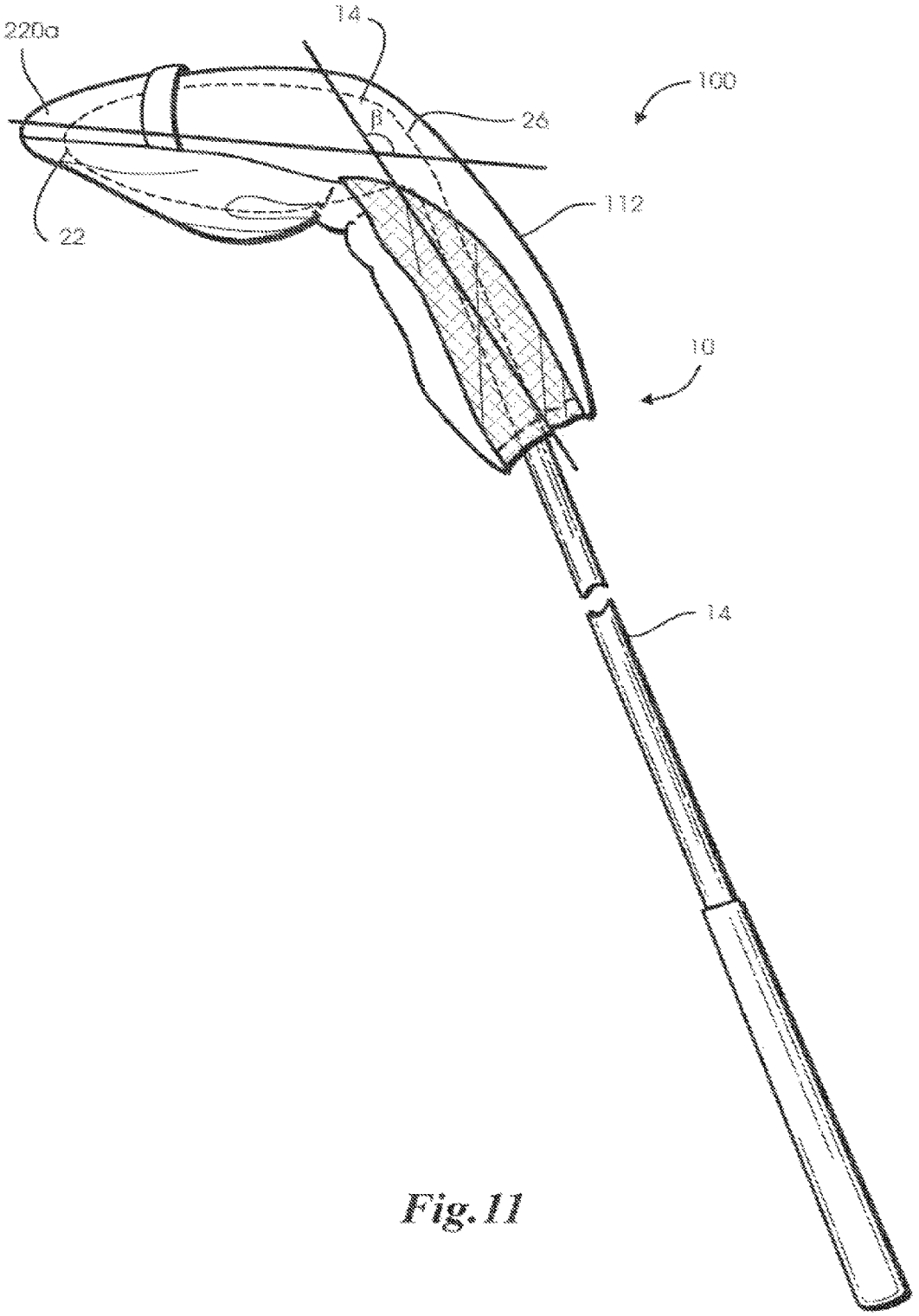
FIG. 11 is another side view of the golf club head cover of FIG. 1 with a golf club head inserted therein.

FIGS. 10-11 illustrate an exemplary golf club 10 including a golf club head 14 that is coupled to a shaft 18. The golf club head 14 defines a toe portion 22 and a heel portion 26. The exemplary golf club head 14 is that of a driver-type golf club, a wood-type golf club, or a hybrid-type golf club. The golf club 14 may be also be an iron-type golf club or a putter-type golf club in other embodiments. The golf club 10 may have any suitable size or shape (e.g., volume).

Figure 2:
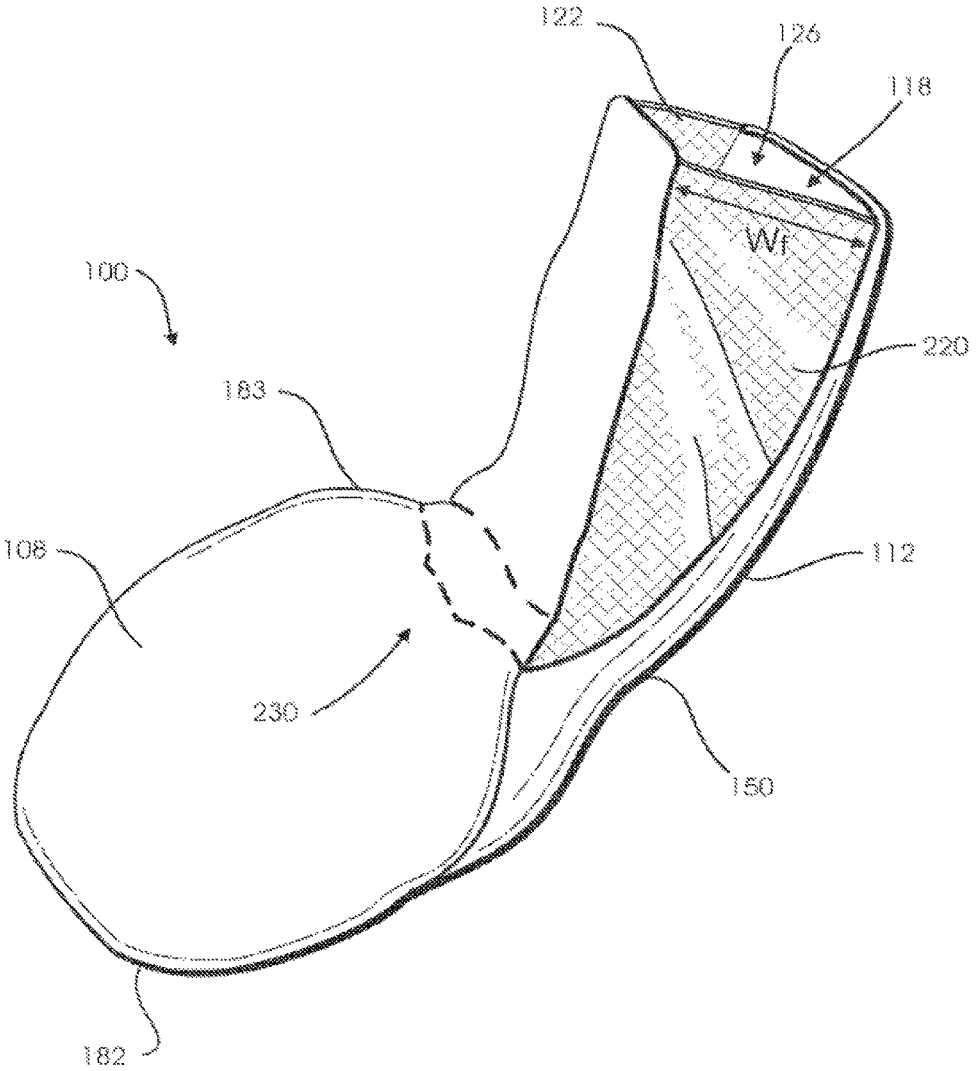
FIG. 2 is a rear side perspective view of the golf club head cover of FIG. 1.
Figure 3:
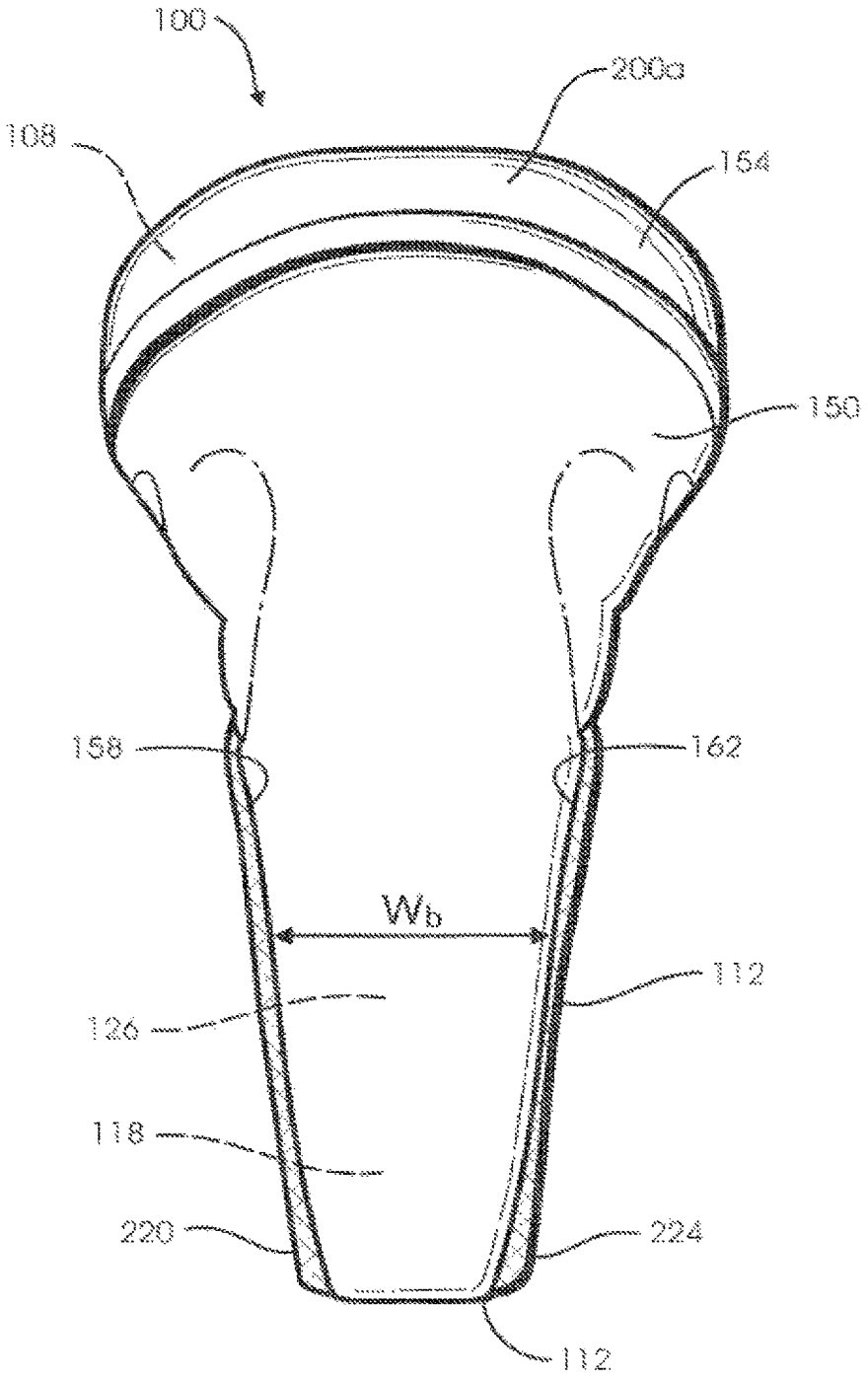
FIG. 3 is a top view of the golf club head cover of FIG. 1.
Figure 3A:
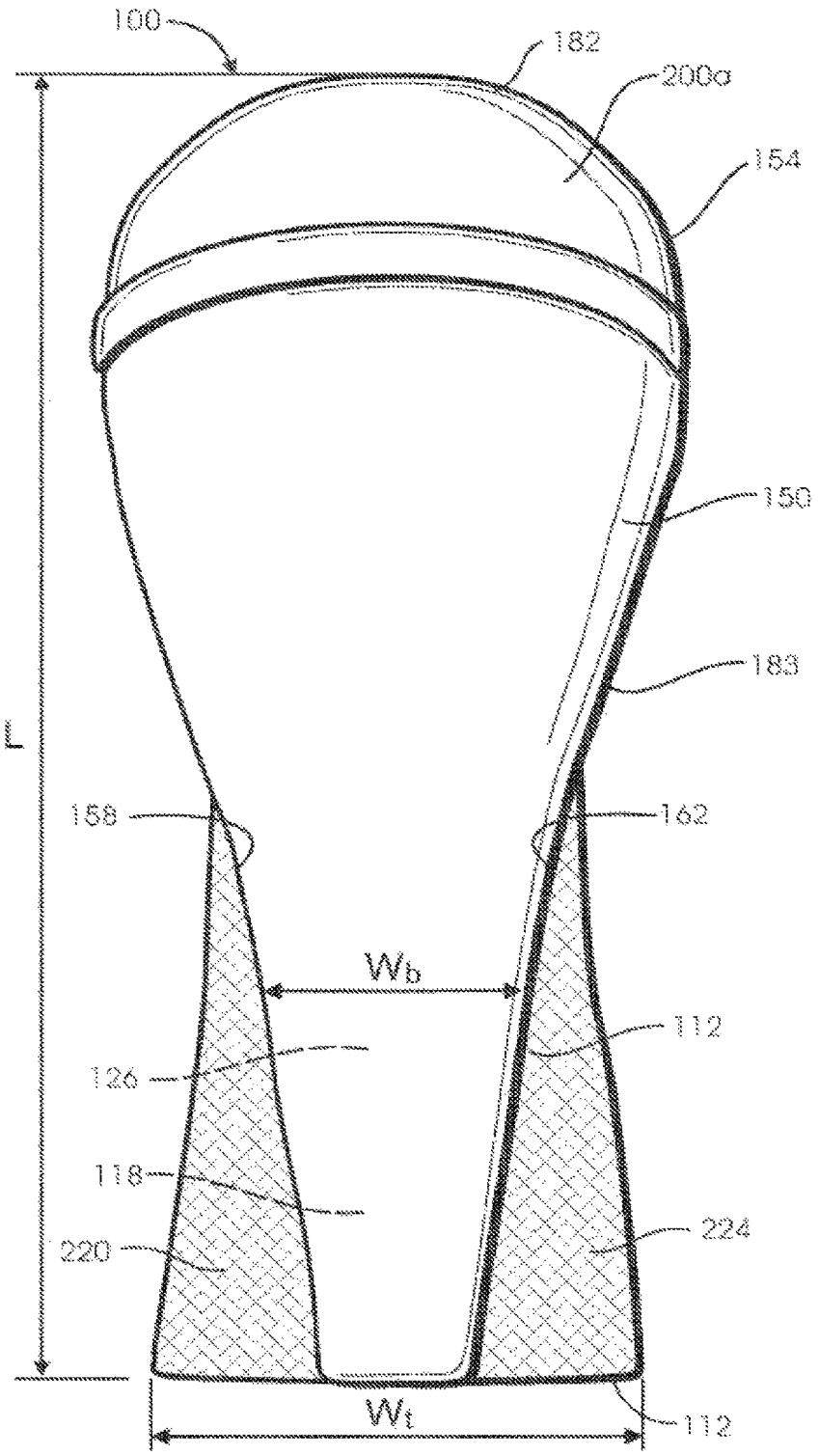
FIG. 3*a* is another top view of the golf club head cover of FIG. 1.
Figure 4:
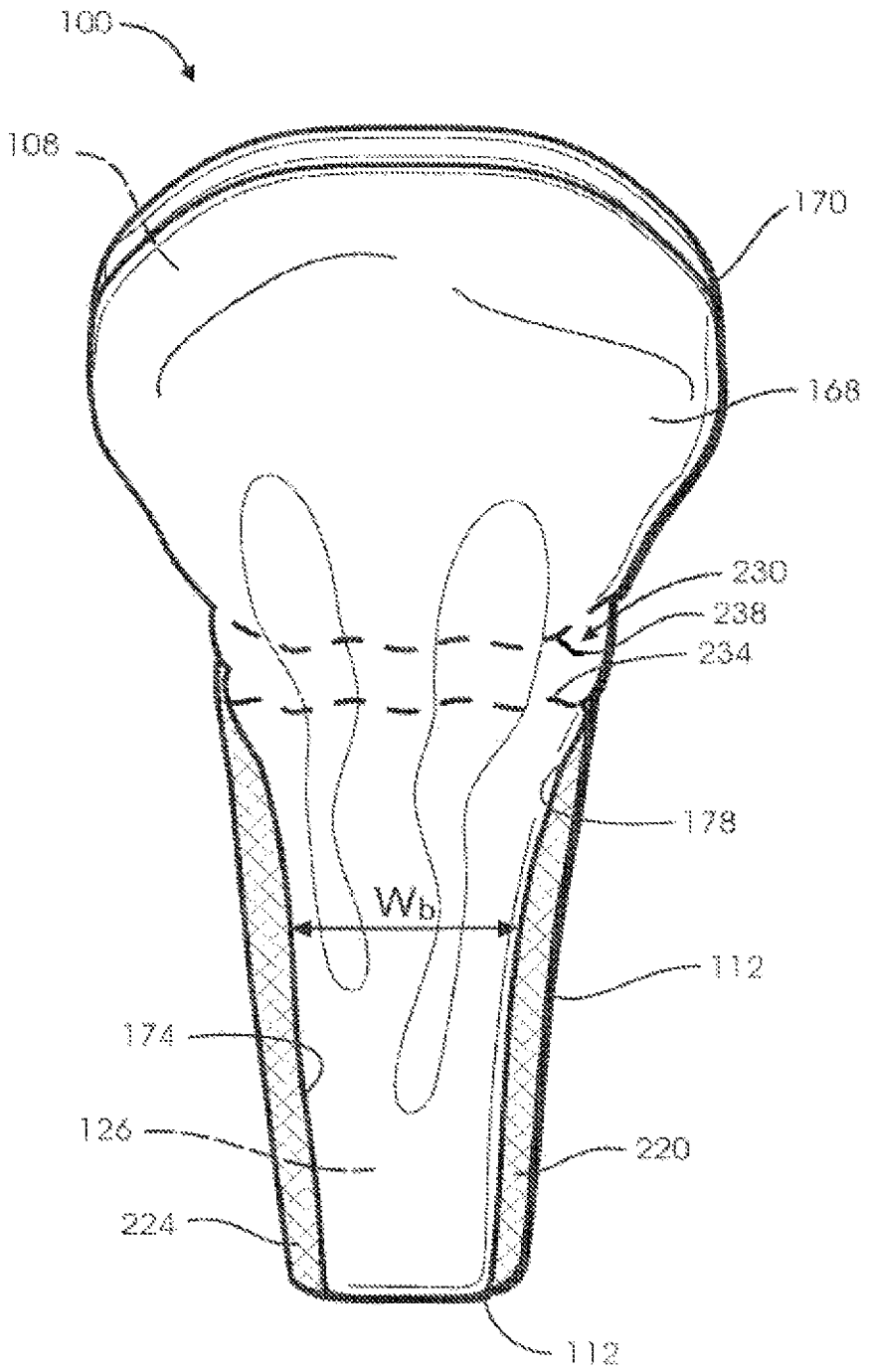
FIG. 4 is a bottom view of the golf club head cover of FIG. 1.
Figure 4A:
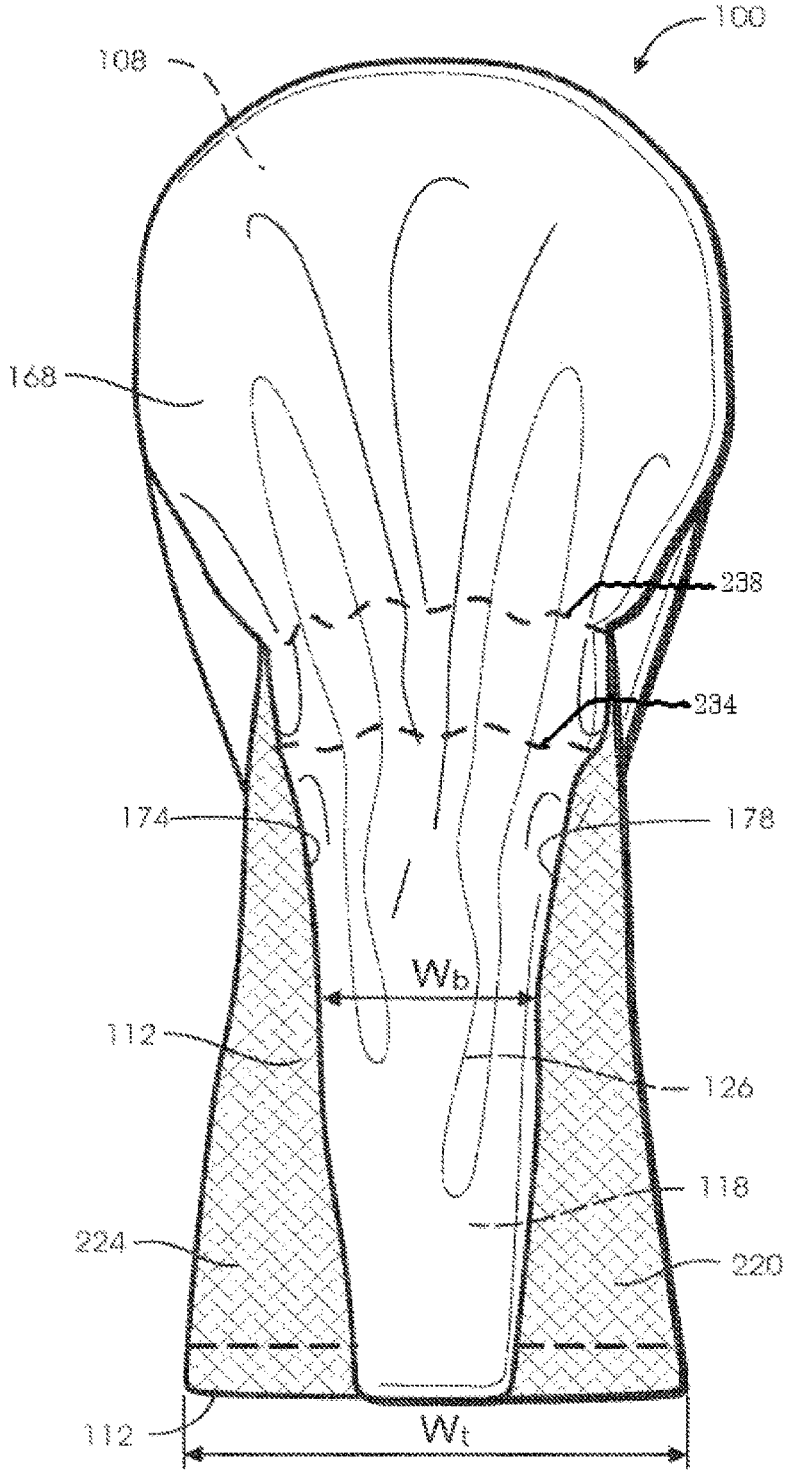
FIG. 4*a* is another bottom view of the golf club head cover of FIG. 1.
Figure 5:
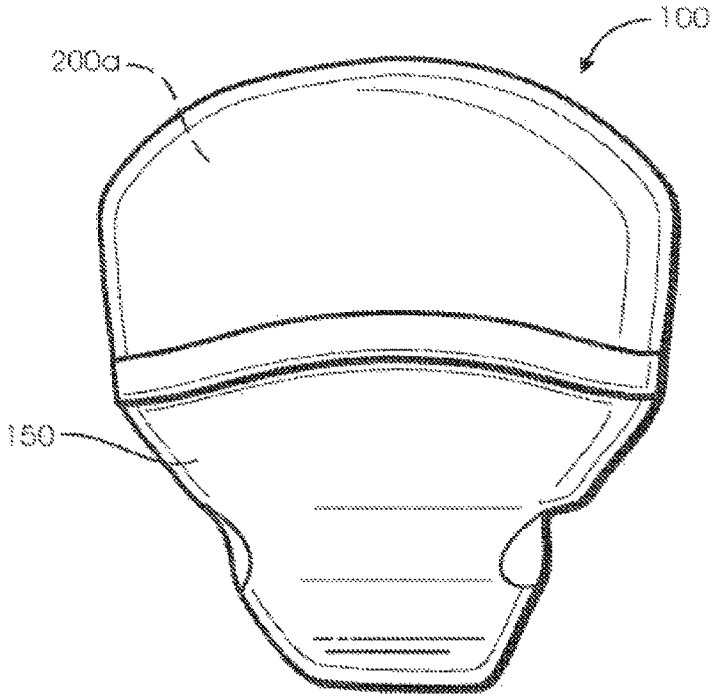
FIG. 5 is a front of the golf club head cover of FIG. 1.

FIGS. 1-11 illustrate a head cover 100 that is configured to receive the golf club head 14 and at least a portion of the shaft 18. The head cover 100 includes a body 104 having a head portion 106 that defines a compartment 108 and a sleeve portion 112 that defines a sleeve conduit 118. The sleeve conduit 118 has an open end 122 of the body 104. The sleeve portion 112 extends from the compartment 108 such that the sleeve conduit 118 is in communication with the compartment 108. Accordingly, the open end 122 is opposite from the compartment 108. Both the compartment 108 and the sleeve portion 112 are selectively expandable and therefore, configured to receive the golf club head 14. As such, a passageway 126 is defined from the open end 122 of the body 104 through the sleeve conduit 118 to the compartment 108 (FIG. 2). The passageway 126 allows the insertion and removal of the golf club head 14 to and from the compartment 108 via the sleeve portion 112. Further, when the golf club head 14 is received within the compartment 108, a portion of the shaft 18 of the golf club 10 is covered by the sleeve portion 112.

The body 104 includes a first or top surface 150 (FIG. 3) that has a substantially arcuately-shaped portion 154 that extends between a first side 158 and a second side 162. The body 104 also includes a second or bottom surface 168 (FIG. 4) that has a substantially arcuately-shaped portion 170 that extends between a first side 174 and a second side 178. The substantially arcuately-shaped portions 154, 170 of each of the top and bottom surfaces 150, 168 are coupled to one another near a first or distal end 182 of the head cover 100. The substantially arcuately-shaped portions 154, 170 of each of the top and the bottoms surfaces 150, 168 at least partially define the compartment 108.

Figure 16:
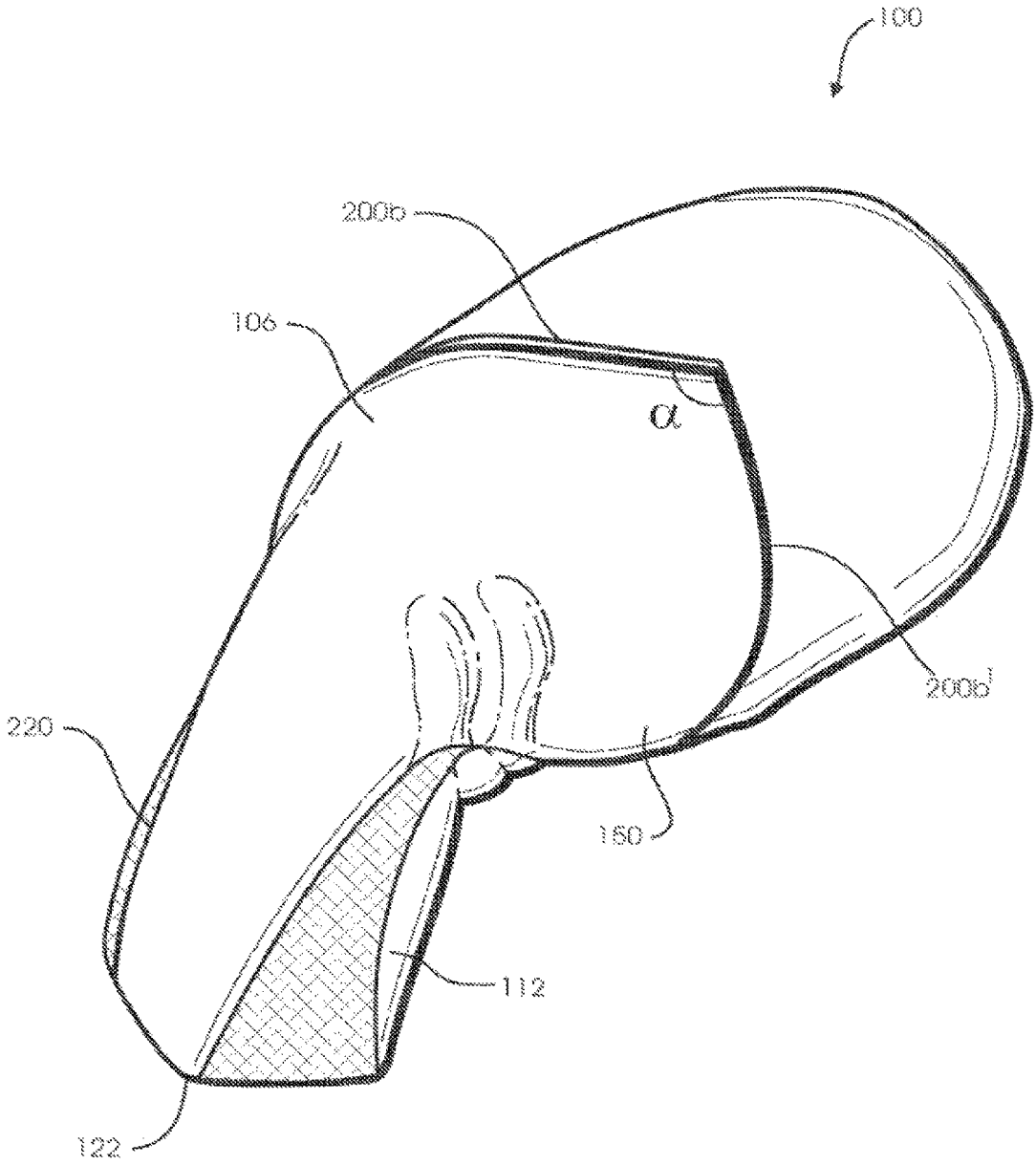
FIG. 16 is a top perspective view of a golf club head cover according to another embodiment of the invention.
Figure 17:
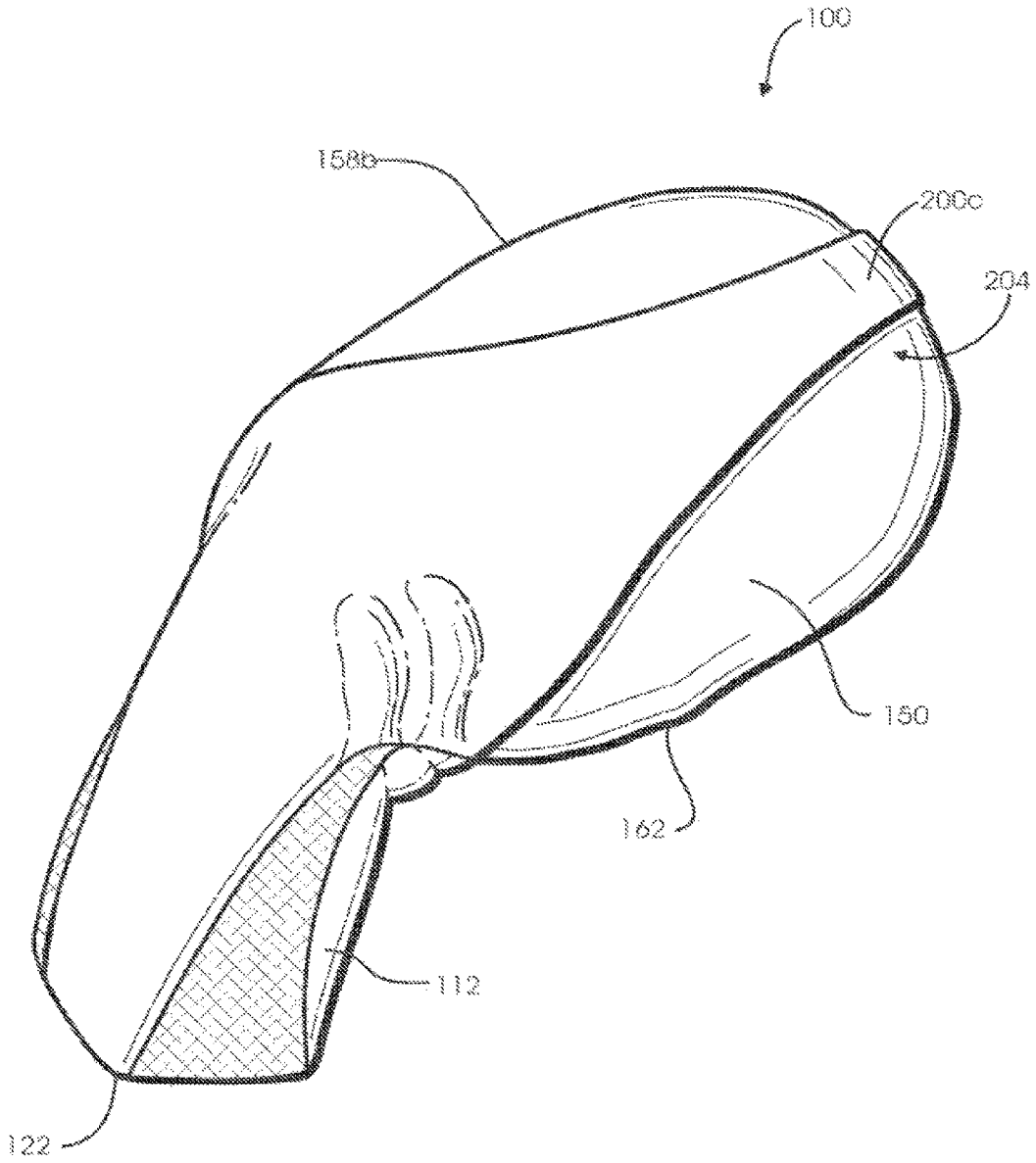
FIG. 17 is a top perspective view of a golf club head cover according to another embodiment of the invention.
Figure 18:
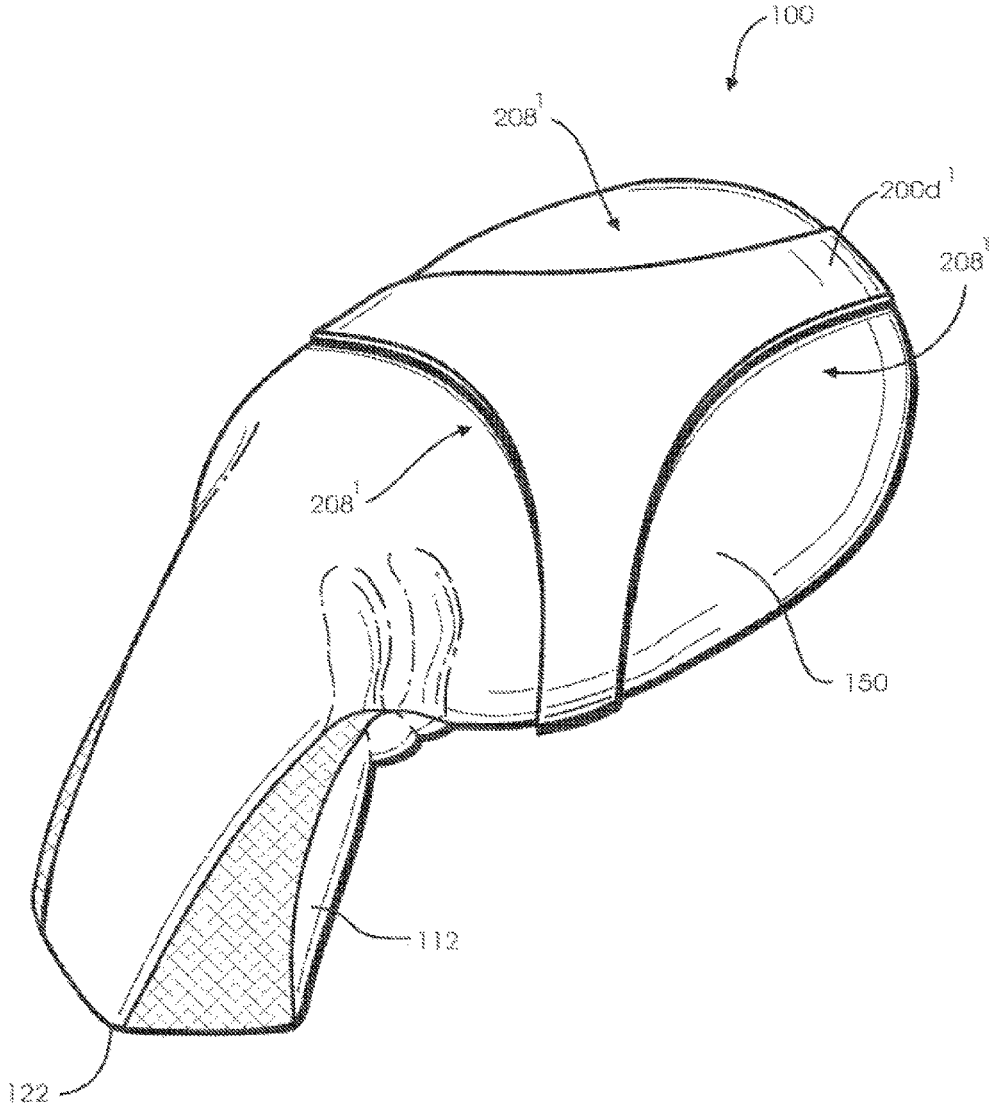
FIG. 18 is a top perspective view of a golf club head cover according to another embodiment of the invention.
Figure 19:
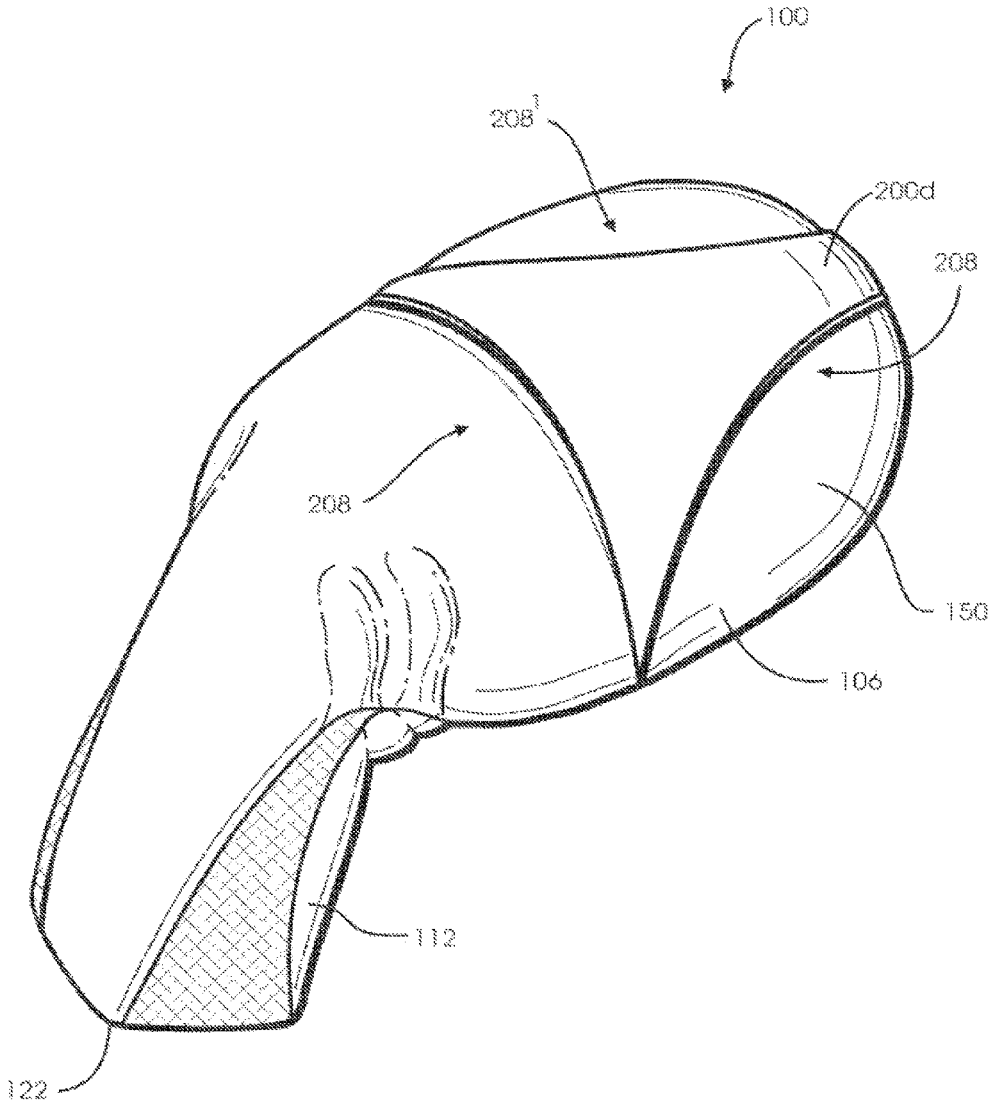
FIG. 19 is a top perspective view of a golf club head cover according to another embodiment of the invention.
Figure 21:
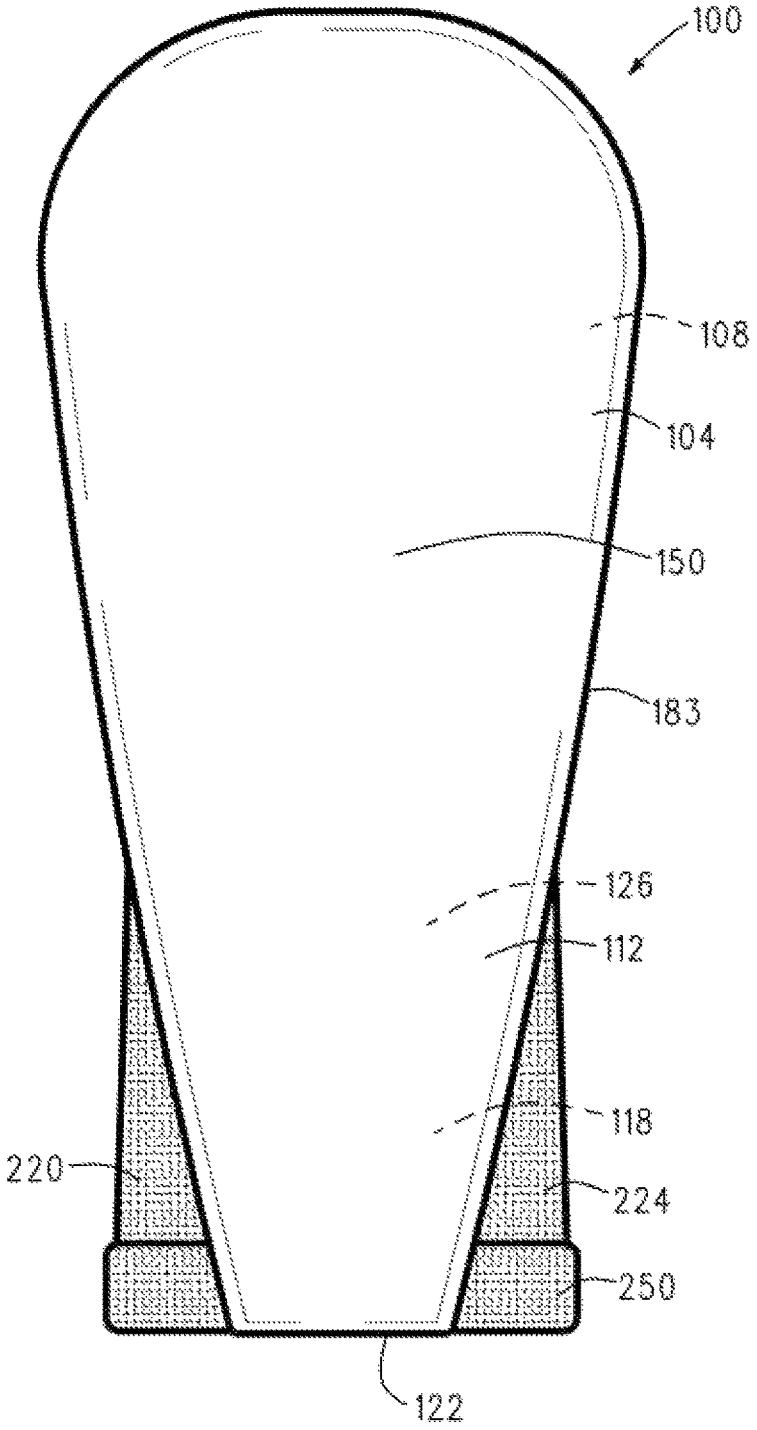
FIGS. 21-23 illustrate a golf club head cover according to another embodiment of the invention.
Figure 22:
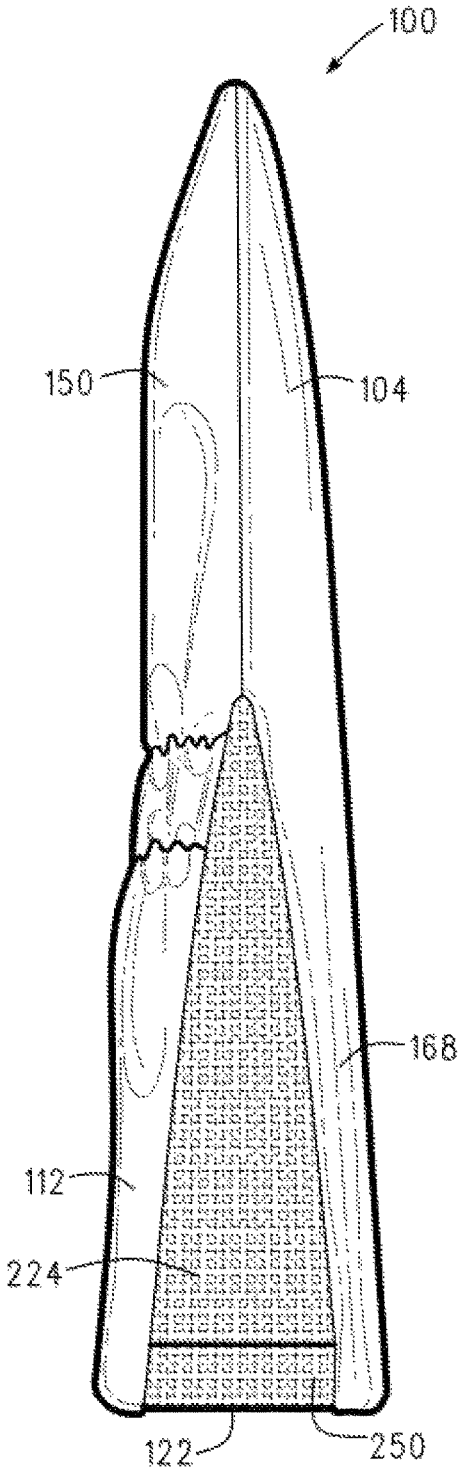
Figure 23:
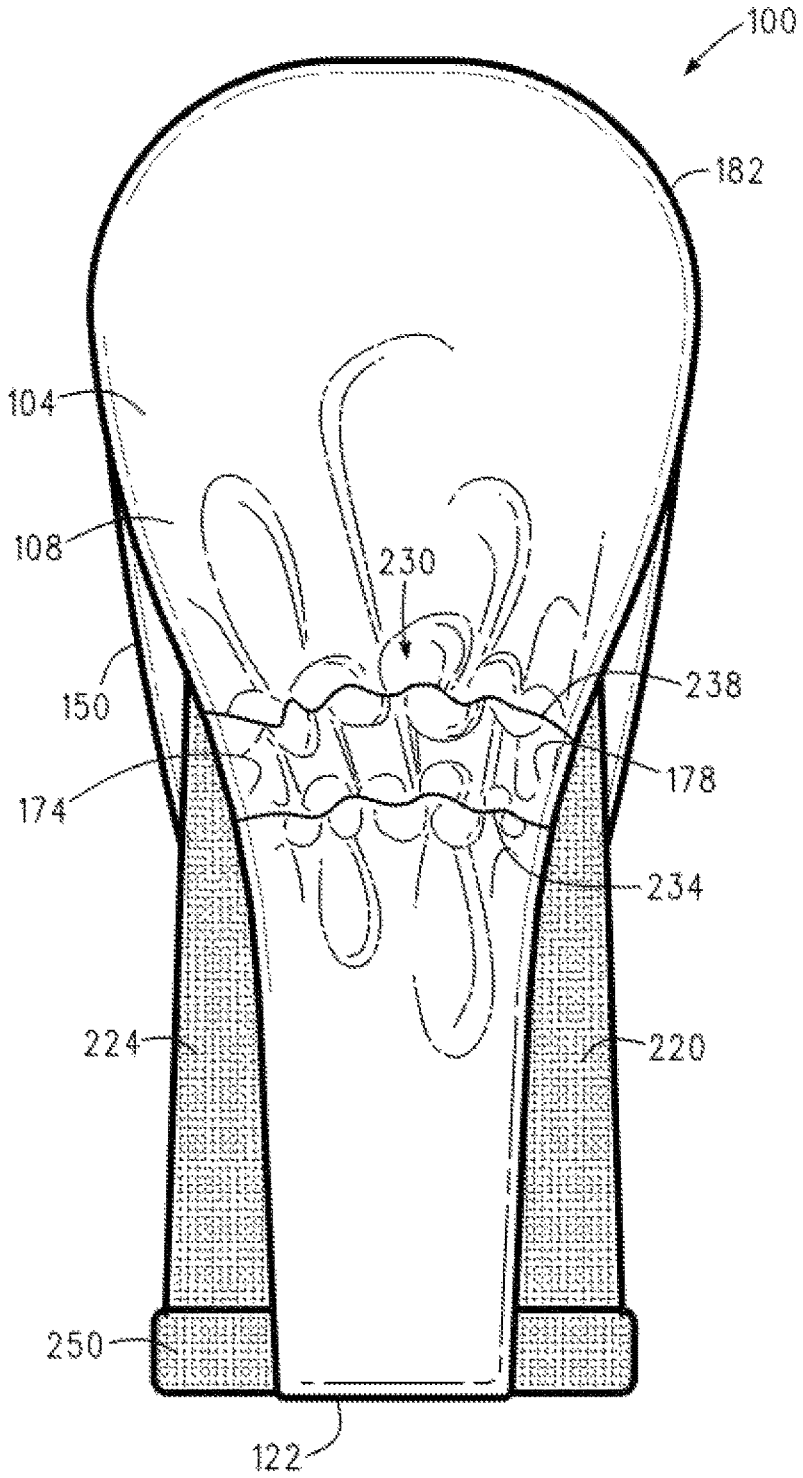

The top surface 150 also includes a first handle 200 that is configured to assist in removing the head cover 100 from the golf club head 14. In the embodiment of FIGS. 1-11, the handle 200 is formed as a pocket having an opening that faces in a substantially downwardly-opening direction away from the arcuately-shaped portion 154. In the embodiments of FIGS. 1-11 the pocket is substantially semi-circular, although in other embodiments the pocket may form a linear or straight line. The downwardly-facing pocket 200 may have any suitable configuration, however. For example, the pocket 200 may be substantially flat 200*a* (FIGS. 1-11) or have two sides 200*b* that form an angle $\alpha$ therebetween (FIG. 16). The angle a between the two sides 200*b* may form any suitable angle $\alpha$ therebetween. Additionally, while the pocket handles 200*a* of FIGS. 1-11 and 16 are substantially centered relative to the top surface 150, the pockets 200*a*, 200*b* may be positioned anywhere on the top surface 150, instead. For example, the pockets 200*a*, 200*b* may be positioned closer to the first and the second sides of the top surface, respectively. Alternatively, the handle 200 may have other configurations. For example, the handle 200 may be a substantially V-shaped handle 200*c* (FIG. 17) and defining a channel 204 therethrough that extends between the first and the second sides 158, 162 of the top surface 150. The handle 200 may alternatively be a substantially Y-shaped handle 200*d*, 200*d*' (FIGS. 18 and 19) such that three openings 208, 208' are defined between the handle 200*d*, 200*d*' and the top surface 150. In other embodiments, such as that of FIGS. 21-23, top surface 150 may not include a pocket.

Further with respect to FIGS. 1-11, the body 104 includes a first flexible or elastic member or panel 220 and a second flexible or elastic member or panel 224. The first and the second elastic members 220, 224 extend between and are coupled to the top and the bottom surfaces 150, 168. In particular, the first elastic member 220 is coupled between the first side 158 of the top surface 150 and the second side 178 of the bottom surface 168, while the second elastic member 224 is coupled between the second side 162 of the top surface 150 and the first side 174 of the bottom surface 168.

Figure 12A:
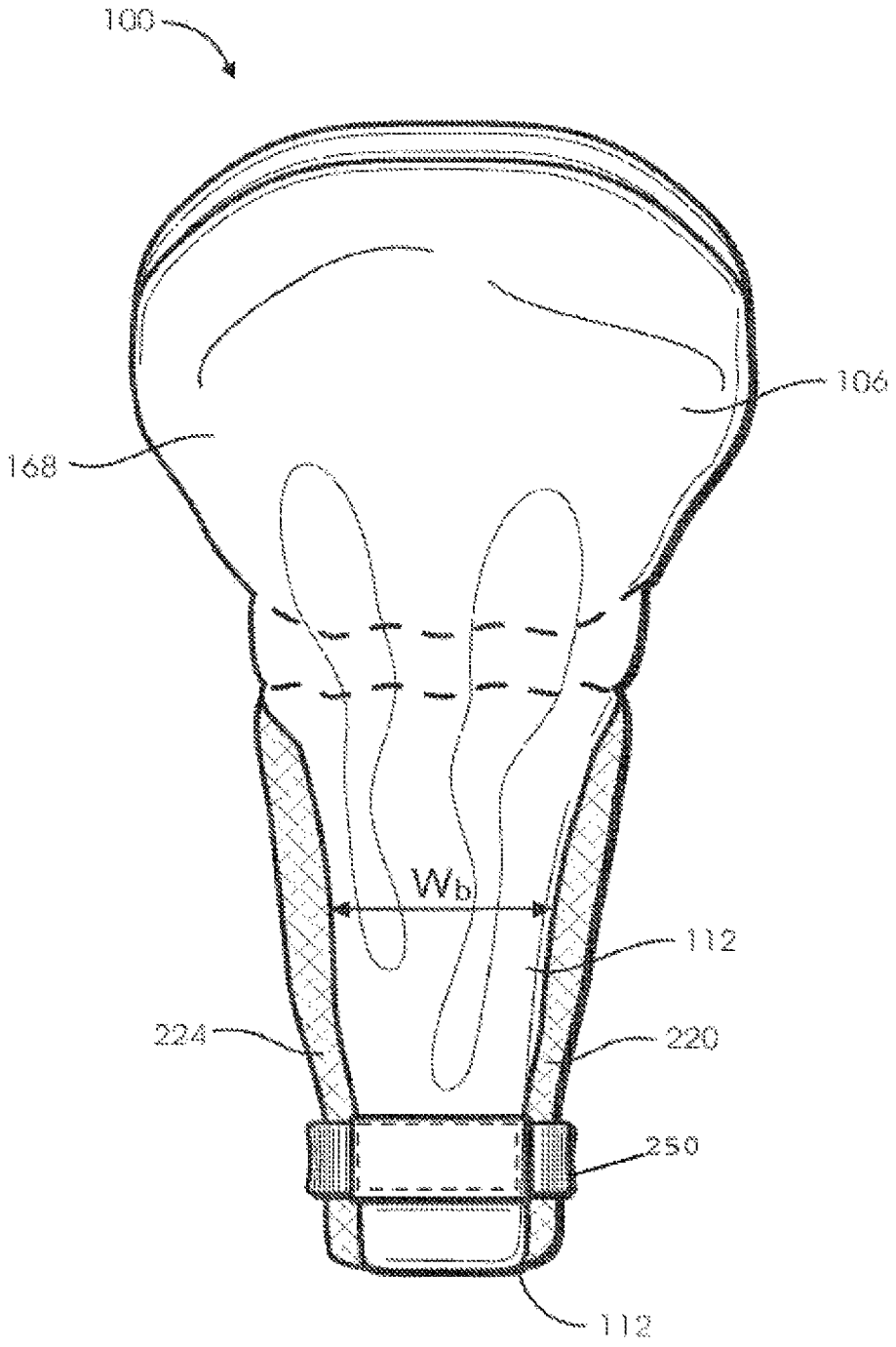
FIG. 12*a* is a bottom side view of the golf club head cover of FIG. 1 and including an auxiliary handle.
Figure 12B:
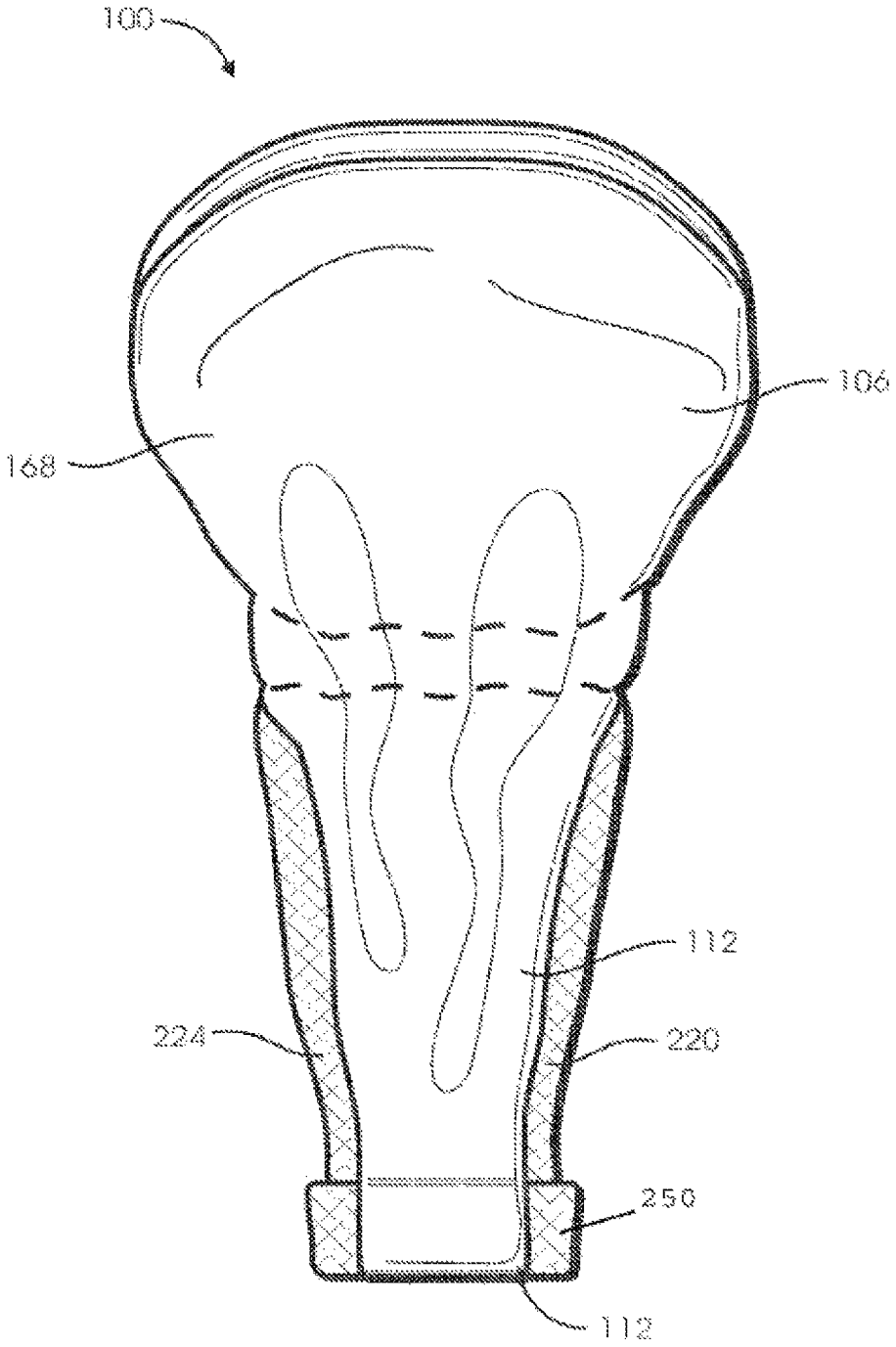
FIG. 12*b* is a bottom side view of the golf club head cover of FIG. 1 and including an alternative auxiliary handle.

The body 104 also includes a narrowed region 230 that is positioned between the head portion 106 and the open end 122. In the embodiment of FIGS. 1-11 and 21-23, the narrowed region 230 is embodied as elastic stitching 234, 238 that extends from the first elastic member 220 to the second elastic member 224 across the bottom surface 168. In the embodiment of FIGS. 12*a*-12*b*, the narrowed region 230 is embodied as elastic stitching 234, 238 that extends between the first side 174 and the second side 178 of the bottom surface 168, above the first and second elastic members 220, 224. In the illustrated embodiments, the narrowed region 230 includes two strips of elastic stitching 234, 328. In other embodiments, the narrowed region 230 can include any number of elastic stitching strips, such as, one, two, three, four, five, or any other number of elastic stitching strips.

The elastic stitching 234, 238, which is constructed from an elastic material, causes the bottom surface 168 of the head cover 100 to pucker or gather along at least a portion of sleeve portion 112, which constricts or pinches the passageway 126 in the narrowed region 230. Accordingly, the sleeve conduit 118 includes a relaxed, un-stretched position (FIGS. 1-4*a* and 11) that constricts or pinches the passageway 126. The elastic stitching 234, 238 allows the narrowed region 230 to be selectively expanded to a stretched position (FIG. 10) such that the passageway 126 is selectively expandable to allow the golf club head 14 to be removably received in the compartment 108. The elastic material may be polyester elastic thread or threads of neoprene, elastane, polyester, acrylic nylon, rayon, acetate, spandex, elastex, and Kevlar or any suitable elastic synthetic fabric. The narrowed region 230 may be implemented in other ways. For example, an auxiliary elastic member may extend between the first and the second elastic members 220, 224.

The body 104 may also include an auxiliary handle 250 (FIGS. 12*a*, 12*b*, and 21-23). In the illustrated embodiment, the auxiliary handle 250 is circumferentially positioned around the open end 122 on both the first elastic member 220 and the second elastic member 220. In some embodiments, the auxiliary handle 250 can be circumferentially positioned around the entire open end 122, or around the open end 122 on the top surface 150 and the bottom surface 168. In other embodiments, the auxiliary handle 250 may only be on one elastic member, or only on one side (e.g., the top surface 150 or the bottom surface 168) of the head cover 100. In other embodiments still, the auxiliary handle 250 may be positioned at other locations (e.g., spaced apart from the open end 122) of the body 104 of the head cover 100. As illustrated, the auxiliary handle 250 extends horizontally relative to the head cover 100. In other embodiments, the auxiliary handle 250 may extend vertically relative to the head cover 100, instead. Further, the auxiliary handle 250 may include any suitable indicia. In many embodiments, the auxiliary handle 250 can facilitate fast and easy positioning of the head cover 100 over a golf club head. For example, during use, the auxiliary handle 250 can allow a user to have better positioning control of the head cover 100 to secure the head cover 100 over the club head.

The top and bottom surfaces 150, 168 are preferably constructed from a material that exhibits a first elasticity. The material of the top and the bottom surfaces 150, 168 may be formed from at least one of leather, neoprene, polyethylene, polyurethane, synthetic rubber, acrylonitrile butadiene styrene (ABS), plastic, or fabric material. The top and the bottom surfaces 150, 168 also includes a liner 270 constructed from felt or cloth, for example, although other soft materials may alternatively be used. As a result, an exterior surface 274 of each of the top and the bottom surfaces 150, 168 is constructed from leather and an interior surface 278 of each of the top and the bottom surfaces 150, 168 is constructed from felt. The felt or other suitable soft material is designed to protect the golf club head 14 from being scratched and the leather or other suitable material is substantially water resistant and also protects the integrity of the golf club head 14. The first and the second elastic members 220, 224 are constructed from a second material that exhibits a second elasticity and is capable of being repeatedly stretched. The material of the first and the second elastic members 220-224 may be elastic polyester sock material, a ribbed elastic polyester sock material, polyurethane, neoprene, elastane, polyester, acrylic nylon, rayon, acetate, spandex, elastex, and Kevlar or any suitable elastic synthetic fabric. The second material is more elastic than the first material.

The compartment 108 of the head cover 100 includes a first, unexpanded state (FIGS. 1-9) and a second, expanded state (FIG. 11). As illustrated in FIGS. 1-9, when the head cover 100 is in the unexpanded state, the compartment 108 is substantially collapsed. As illustrated in FIG. 10, the head cover 100 achieves the expanded state when the golf club head 14 is inserted into the compartment 108.

The sleeve portion 112 is configured to progressively expand as a golf club head 14 is inserted into and moves therethrough to the compartment 108. Accordingly, the sleeve portion 112 expands and collapses independently of the compartment 108. When a golf club head 14 is inserted into the open end 122 of the sleeve portion 112, the first and the second elastic members 220, 224 enable the passageway to expand to accommodate the volume of the golf club head 14. For example, the pressure or force exerted by the golf club head 14 as it is inserted into the open end 122 forces the sleeve portion 112 to expand. As the golf club head 14 continues to be inserted into the sleeve conduit 118, the continued pressure or force exerted by the golf club head 14 expands the passageway 126 at the narrowed region 230 to allow the golf club head 14 to pass from the sleeve portion 112 into the compartment 108. Once the golf club head passes the narrowed region 230 and is positioned within the compartment 108, the passageway 126 contracts so that the head cover 100 securely hugs the golf club head 14.

In the illustrated embodiment, a length L of the golf club head cover 100 is preferably in the range of 5 inches to 15 inches. The length L of the golf club head cover 100 is dependent upon the type of golf club 10 for which the golf club head cover 100 is designed to cover. Therefore, in the illustrated embodiments, the golf club head cover 100 is approximately 14 inches, which is suitable for a driver-type golf club. However, the golf club head cover 100 may be 5.0 inches, 5.1 inches, 5.2 inches, 5.3 inches, 5.4 inches, 5.5 inches, 5.6 inches, 5.7 inches, 5.8 inches, 5.9 inches, 6.0 inches, 6.1 inches, 6.2 inches, 6.3 inches, 6.4 inches, 6.5 inches, 6.6 inches, 6.7 inches, 6.8 inches, 6.9 inches, 7.0 inches, 7.1 inches, 7.2 inches, 7.3 inches, 7.4 inches, 7.5 inches, 7.6 inches, 7.7 inches, 7.8 inches, 7.9 inches, 8.0 inches, 8.1 inches, 8.2 inches, 8.3 inches, 8.4 inches, 8.5 inches, 8.6 inches, 8.7 inches, 8.8 inches, 8.9 inches, 9.0 inches, 9.1 inches, 9.2 inches, 9.3 inches, 9.4 inches, 9.5 inches, 9.6 inches, 9.7 inches, 9.8 inches, 9.9 inches, 10.0 inches, 10.1 inches, 10.2 inches, 10.3 inches, 10.4 inches, 10.5 inches, 10.6 inches, 10.7 inches, 10.8 inches, 10.9 inches, 11.0 inches, 11.1 inches, 11.2 inches, 11.3 inches, 11.4 inches, 11.5 inches, 11.6 inches, 11.7 inches, 11.8 inches, 11.9 inches, 12.0 inches, 12.1 inches, 12.2 inches, 12.3 inches, 12.4 inches, 12.5 inches, 12.6 inches, 12.7 inches, 12.8 inches, 12.9 inches, 13.0 inches, 13.1 inches, 13.2 inches, 13.3 inches, 13.4 inches, 13.5 inches, 13.6 inches, 13.7 inches, 13.8 inches, 13.9 inches, 14.0 inches, 14.1 inches, 14.2 inches, 14.3 inches, 14.4 inches, 14.5 inches, 14.6 inches, 14.7 inches, 14.8 inches, 14.9 inches, or 15.0 inches.

In the illustrated embodiment, the top surface 150 and the bottom surface 168 include a width $W_b$ that is defined between the respective first sides 158, 174 and the second sides 164, 178. The widths $W_b$ decrease or narrow in a direction from the substantially arcuately-shaped portions 154, 170 to the open end. The widths $W_b$ at the narrowest point is adjacent the open end 122 and is preferably in the range of 0.5-2.0 inches. In the illustrated embodiment, the width $W_b$ at the narrowest point is approximately 1.5 inches. However, in additional embodiments the width $W_b$ may be approximately 0.5 inches, 0.6 inches, 0.7 inches, 0.8 inches, 0.9 inches, 1.0 inches, 1.1 inches, 1.2 inches, 1.3 inches, 1.4 inches, 1.5 inches, 1.6 inches, 1.7 inches, 1.8 inches, 1.9 inches, or 2.0 inches. In other embodiments it is also contemplated that the width $W_b$ may be uniform or may increase between the respective first sides 158, 174 and the second sides 164, 178.

Also, the first and the second elastic members 220, 224 are substantially triangularly shaped and define a base that has a width $W_f$. The widths $W_f$ at the widest point is adjacent the open end 122 and is preferably in the range of 1.0-3.0 inches. In the illustrated embodiment, the width $W_t$ at the widest point is approximately 2.5 inches. However, in additional embodiments the width $W_t$ may be approximately 1.0 inches, 1.1 inches, 1.2 inches, 1.3 inches, 1.4 inches, 1.5 inches, 1.6 inches, 1.7 inches, 1.8 inches, 1.9 inches, 2.0 inches, 2.1 inches, 2.2 inches, 2.3 inches, 2.4 inches, 2.5 inches, 2.6 inches, 2.7 inches, 2.8 inches, 2.9 inches, or 3.0 inches. In other embodiments it is also contemplated that the first and the second elastic members may be shaped differently. For example, in other embodiments, the first and the second elastic members 220, 224 may be rectangular such that the width $W_f$ is be uniform or may be an inverted triangle such that the width $W_f$ may increase in a direction away from the open end.

As a result of this configuration, the sleeve portion 112 is both easily collapsible and provides an enlarged open end 122, which will be discussed below, when compared to known head covers.

Figure 6:
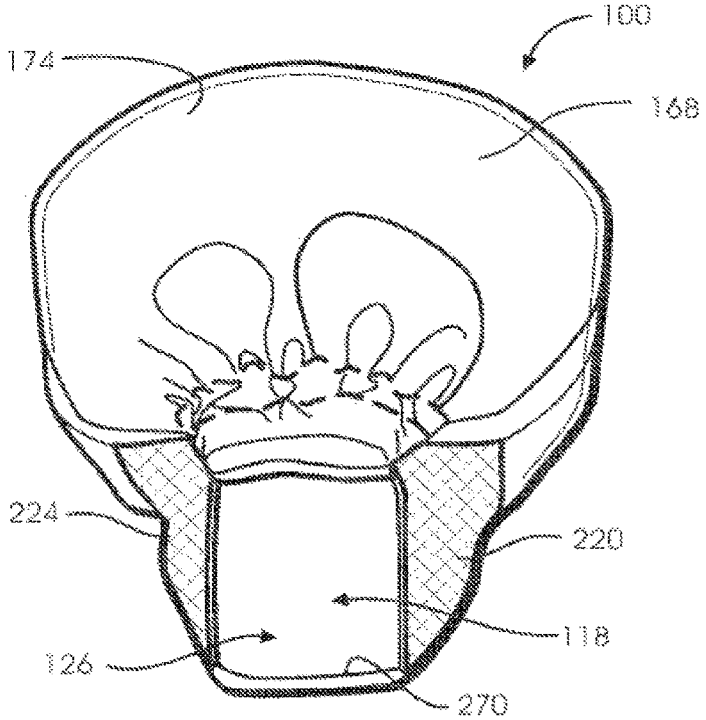
FIGS. 6, 6*a*, and 6*b* are views from an open end of the golf club head cover of FIG. 1.
Figure 6A:
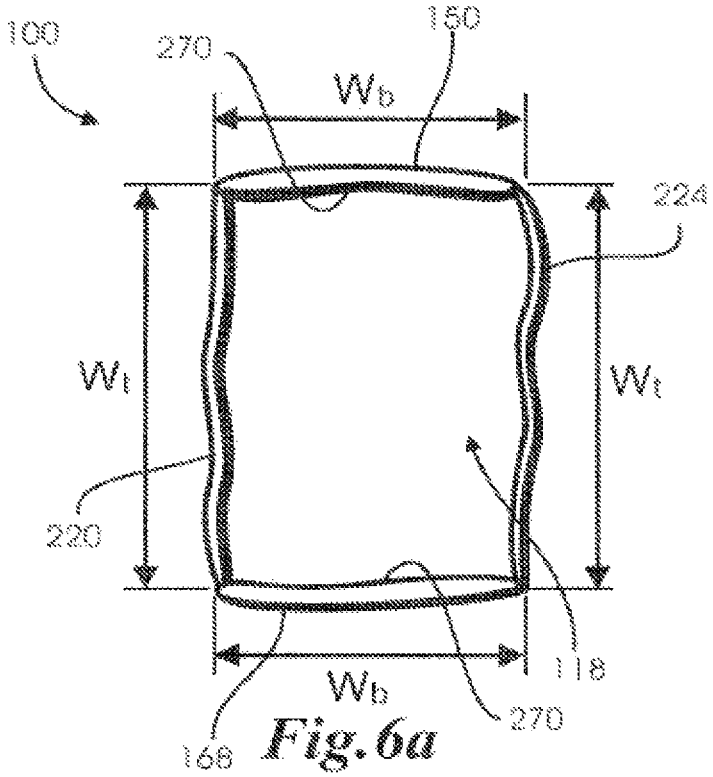
Figure 6B:
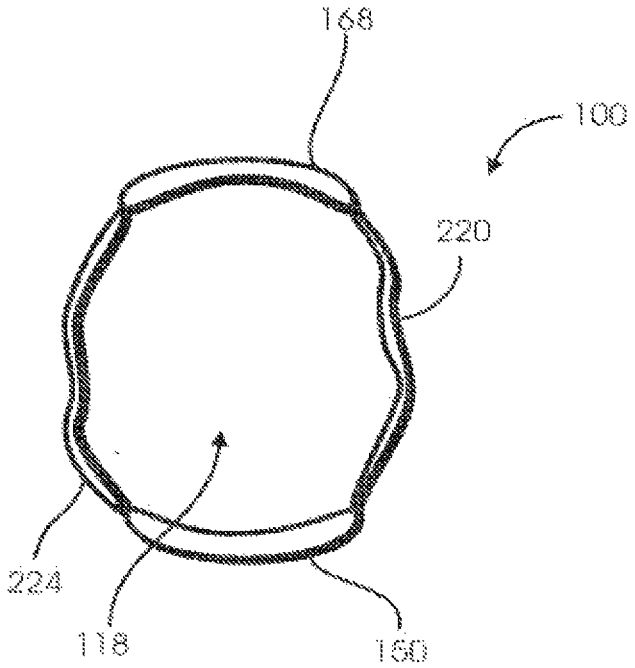

Prior to the golf club head 14 being inserted into the passageway 126 and when not in use, the first and the second elastic members 220, 224 be folded or flattened outwardly such that the sleeve portion 112 flattens and defines a width $W_t$ of the body 104 near the open end 122. Therefore, as illustrated, the sleeve portion 112 when not in use is substantially rectangularly-shaped and substantially flat. The width $W_t$ is preferably in the range of approximately 2.0-6.0 inches. In the embodiments illustrated herein, the width $W_t$ is approximately 4.5 inches. However, in additional embodiments the width $W_t$ may be approximately 2.0 inches, 2.1 inches, 2.2 inches, 2.3 inches, 2.4 inches, 2.5 inches, 2.6 inches, 2.7 inches, 2.8 inches, 2.9 inches, 3.0 inches, 3.1 inches, 3.2 inches, 3.3 inches, 3.4 inches, 3.5 inches, 3.6 inches, 3.7 inches, 3.8 inches, 3.9 inches, 4.0 inches, 4.1 inches, 4.2 inches, 4.3 inches, 4.4 inches, 4.5 inches, 4.6 inches, 4.7 inches, 4.8 inches, 4.9 inches, 5.0 inches, 5.1 inches, 5.2 inches, 5.3 inches, 5.4 inches, 5.5 inches, 5.6 inches, 5.7 inches, 5.8 inches, 5.9 inches, or 6.0 inches. When preparing to insert the golf club head 14 into the sleeve portion 112 through the open end 122, the sleeve conduit 118 defines substantially a pyramid that is truncated. Accordingly, the open end 122 of the sleeve portion is defined by the width $W_b$ of the top and the bottom surfaces 150, 168 at the open end 122 and the width of the base $W_f$ of the first elastic member 220 and the second elastic member 224 such that the open end 122 is substantially rectangular and defines an area ($W_b$*$W_f$) of about 0.25-6.0 inches$^2$. In the illustrated embodiments, the area of the open end is approximately 3.75 inches. However, in other embodiments the area may be approximately 0.2 inches$^2$, 0.3 inches$^2$, 0.4 inches$^2$, 0.5 inches$^2$, 0.6 inches$^2$, 0.7 inches$^2$, 0.8 inches$^2$, 0.9 inches$^2$, 1.0 inches$^2$, 1.1 inches$^2$, 1.2 inches$^2$, 1.3 inches$^2$, 1.4 inches$^2$, 1.5 inches$^2$, 1.6 inches$^2$, 1.7 inches$^2$, 1.8 inches$^2$, 1.9 inches$^2$, 2.0 inches$^2$, 2.1 inches$^2$, 2.2 inches$^2$, 2.3 inches$^2$, 2.4 inches$^2$, 2.5 inches$^2$, 2.6 inches$^2$, 2.7 inches$^2$, 2.8 inches$^2$, 2.9 inches$^2$, 3.0 inches$^2$, 3.1 inches$^2$, 3.2 inches$^2$, 3.3 inches$^2$, 3.4 inches$^2$, 3.5 inches$^2$, 3.6 inches$^2$, 3.7 inches$^2$, 3.8 inches$^2$, 3.9 inches$^2$, 4.0 inches$^2$, 4.1 inches$^2$, 4.2 inches$^2$, 4.3 inches$^2$, 4.4 inches$^2$, 4.5 inches$^2$, 4.6 inches$^2$, 4.7 inches$^2$, 4.8 inches$^2$, 4.9 inches$^2$, 5.0 inches$^2$, 5.1 inches$^2$, 5.2 inches$^2$, 5.3 inches$^2$, 5.4 inches$^2$, 5.5 inches$^2$, 5.6 inches$^2$, 5.7 inches$^2$, 5.8 inches$^2$, 5.9 inches$^2$, or 6.0 inches$^2$. When manipulated in other ways the open end 122 takes on other shapes. For example, the open end is also ovular as illustrated in FIG. 6*b* but the area defined by the open end 122 remains substantially the same. Because the first and the second elastic members 220, 224 are substantially triangular, the width $W_f$ decreases along the length of the sleeve conduit 118. Accordingly, the passageway 126 from the open end 122 through the sleeve portion 112 narrows along the length of the sleeve conduit 118 to the narrowed region 230. The elastic stitching 234, 238 of the narrowed region 230 constricts the passageway 126 in the area of the narrowed region 230. However, because of the elastic material of the first and the second elastic members 220, 224 and the narrowed region 230, the passageway 126 is configured to selectively expand to allow the golf club head 14 to pass therethrough. Once the golf club head 14 has passed the elastic properties of the first and the second elastic members 220, 224 and the narrowed region 230 are configured to contract the passageway 126 to ensure that the head cover 100 remains secured about the golf club head 14.

To remove the head cover 100 from the golf club head 14, the user only has to exert a force on the handle 200 away from the golf club 10.

Because the inventive configuration of the sleeve portion 112, the head cover 100 is more easily applied and removed to the golf club head 14.

Figure 7:
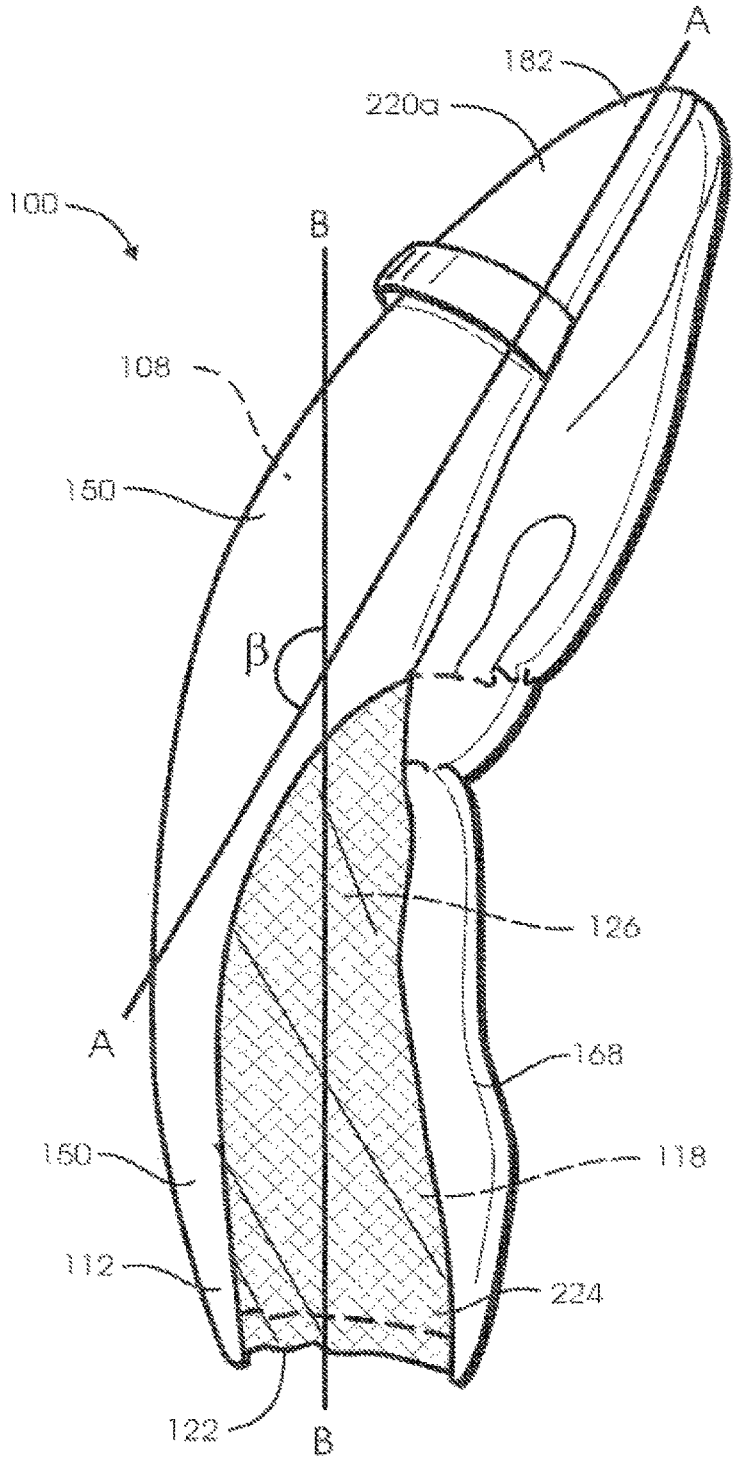
FIG. 7 is a first side view of the golf club head cover of FIG. 1.
Figure 8:
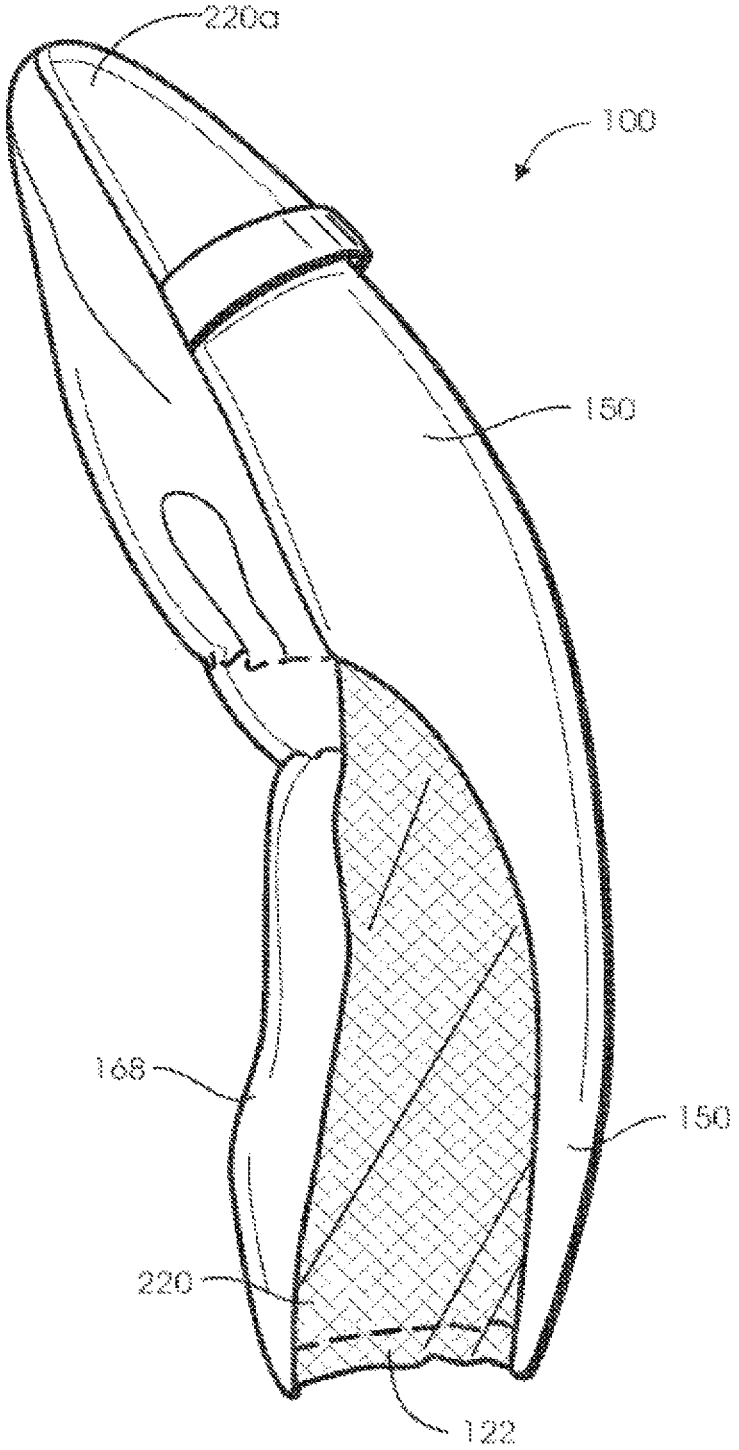
FIG. 8 is a second side view of the golf club head cover of FIG. 1.
Figure 9:
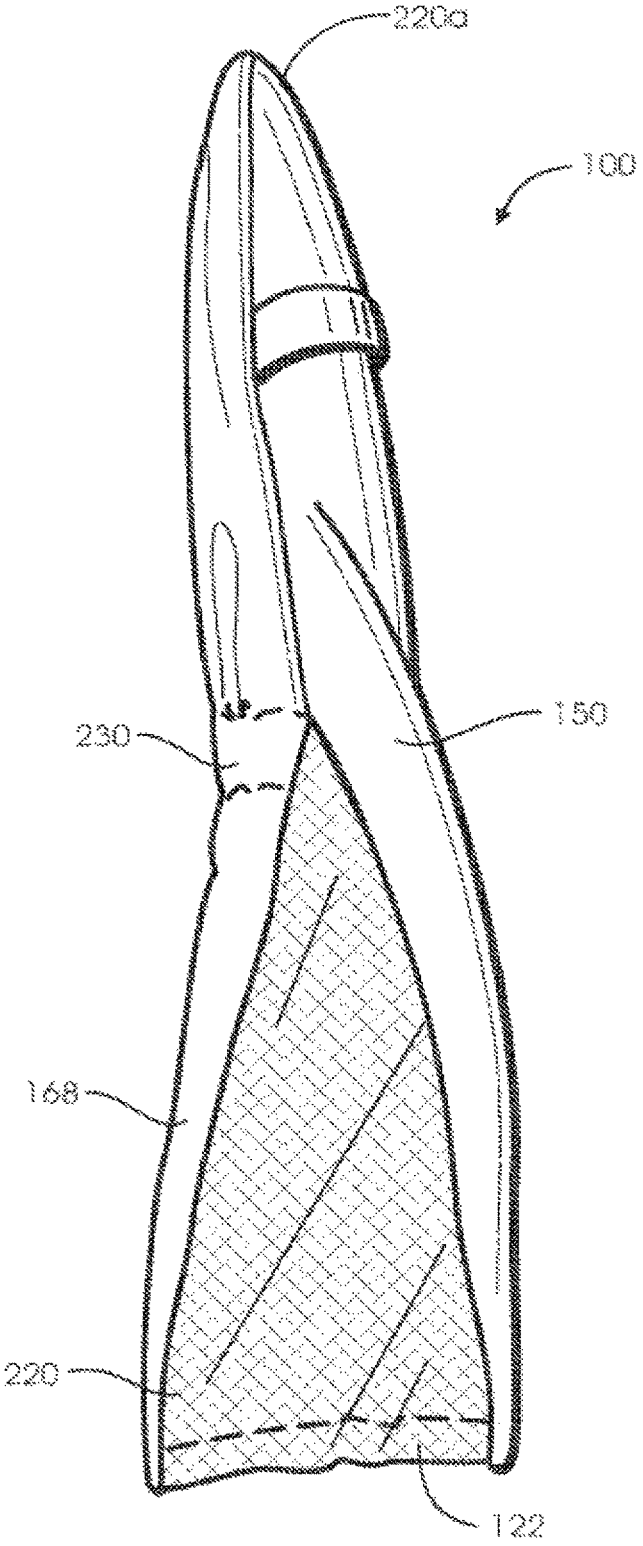
FIG. 9 is another second side view of the golf club head cover of FIG. 1.

In the illustrated embodiment, the compartment 108 defines an axis A and the sleeve portion defines an axis B. The first axis A and the second axis B are positioned at an angle β relative to one another when the head cover 100 is not in use (FIG. 7). The angle β is preferably less than 180 degrees. When head cover 100 is in use, the compartment 108 moves relative to the sleeve portion 112 such that the angle β between the two axes A, B decreases (FIG. 11).

Figure 13:
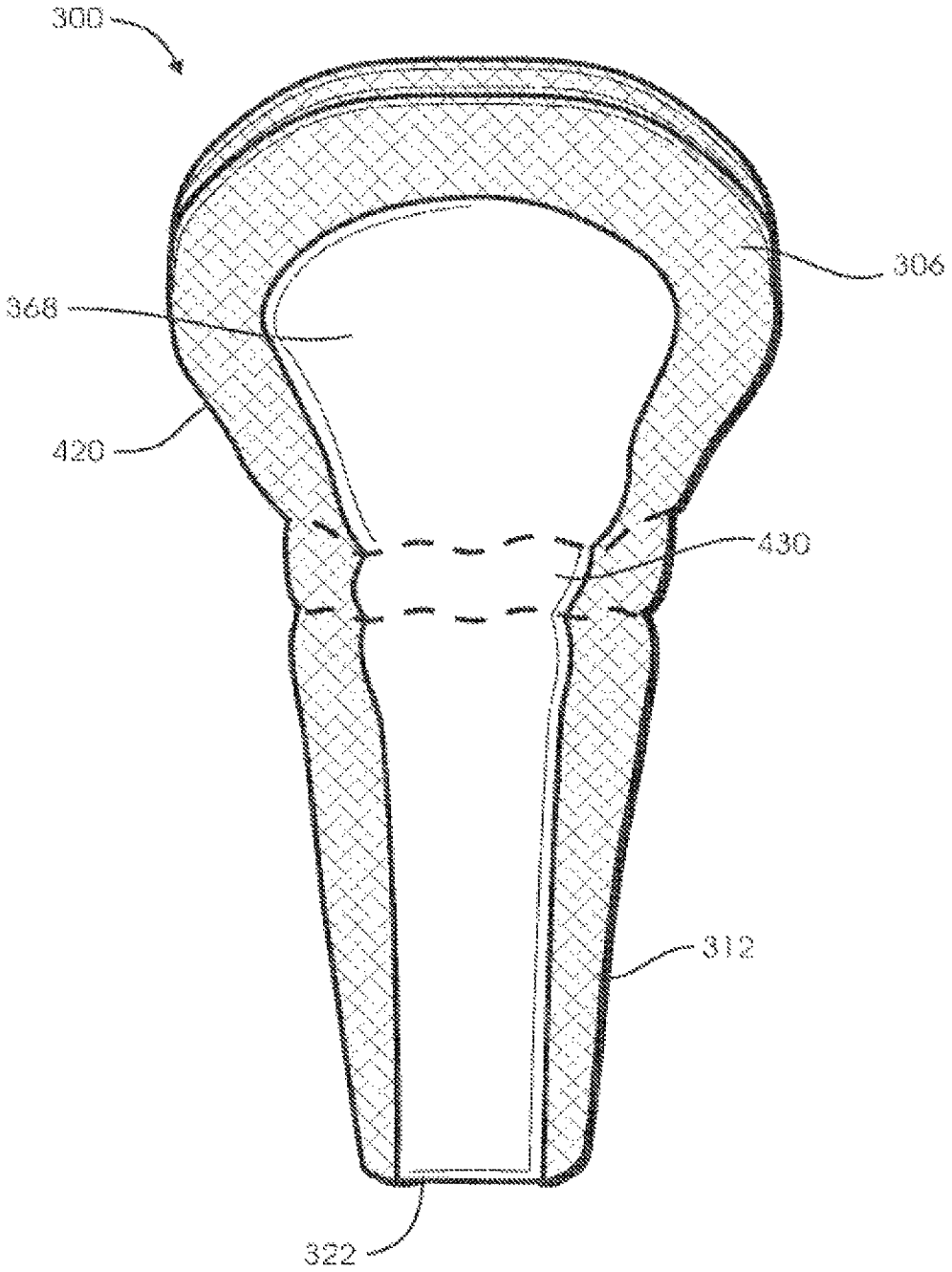
FIG. 13 is a bottom view of a golf club head cover according to another embodiment of the invention.

The golf club head cover 100 may have other configurations as well. For example, FIG. 13 illustrates a golf club head cover 300 according to another embodiment of the invention. The golf club head cover 300 of FIG. 13 is similar to the golf club head cover 100 of FIGS. 1-11. Therefore, like structure will be identified by like reference numbers plus "200" and only the differences will be discussed hereafter.

The golf club head cover 300 of FIG. 13 includes a continuous elastic member or panel 420 that extends between the top and the bottom surfaces 350, 368 (only the bottom surface 368 is shown) such that the continuous elastic member 420 completely surrounds both the top and bottom surfaces 368 on all sides. The top and bottom surfaces 350, 368 are constructed from the first material and the continuous elastic member 420 is constructed from the second material discussed above with respect to FIGS. 1-11.

Figure 14:
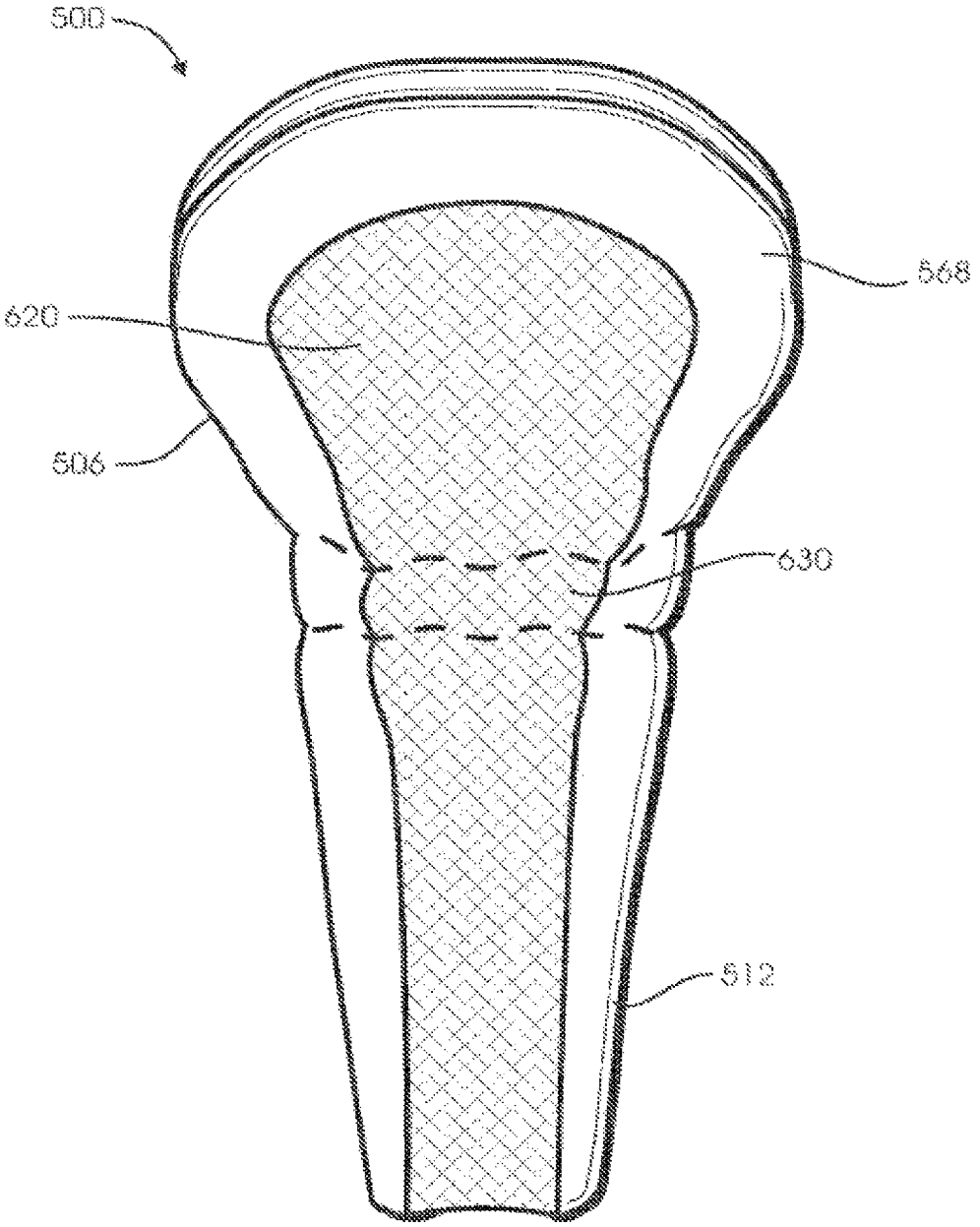
FIG. 14 is a bottom view of a golf club head cover according to another embodiment of the invention.

Another exemplary head cover 500 is illustrated in FIGS. 14. The golf club head cover 500 of FIG. 14 is similar to the golf club head cover 100 of FIGS. 1-11. Therefore, like structure will be identified by like reference numbers plus "400" and only the differences will be discussed hereafter.

The golf club head cover 500 of FIG. 14 includes a central elastic member or panel 620 that makes up a portion of the bottom surface 568. Although, not illustrated, the top surface 550 may also include a central or elastic member or panel 620. The top and bottom surfaces 350, 368 are constructed from the first material and the central elastic member 620 is constructed from the second material discussed above with respect to FIGS. 1-11. Accordingly, both the head portion 506 and the sleeve portion 512 are constructed from both the first material and the second material.

Figure 15A:
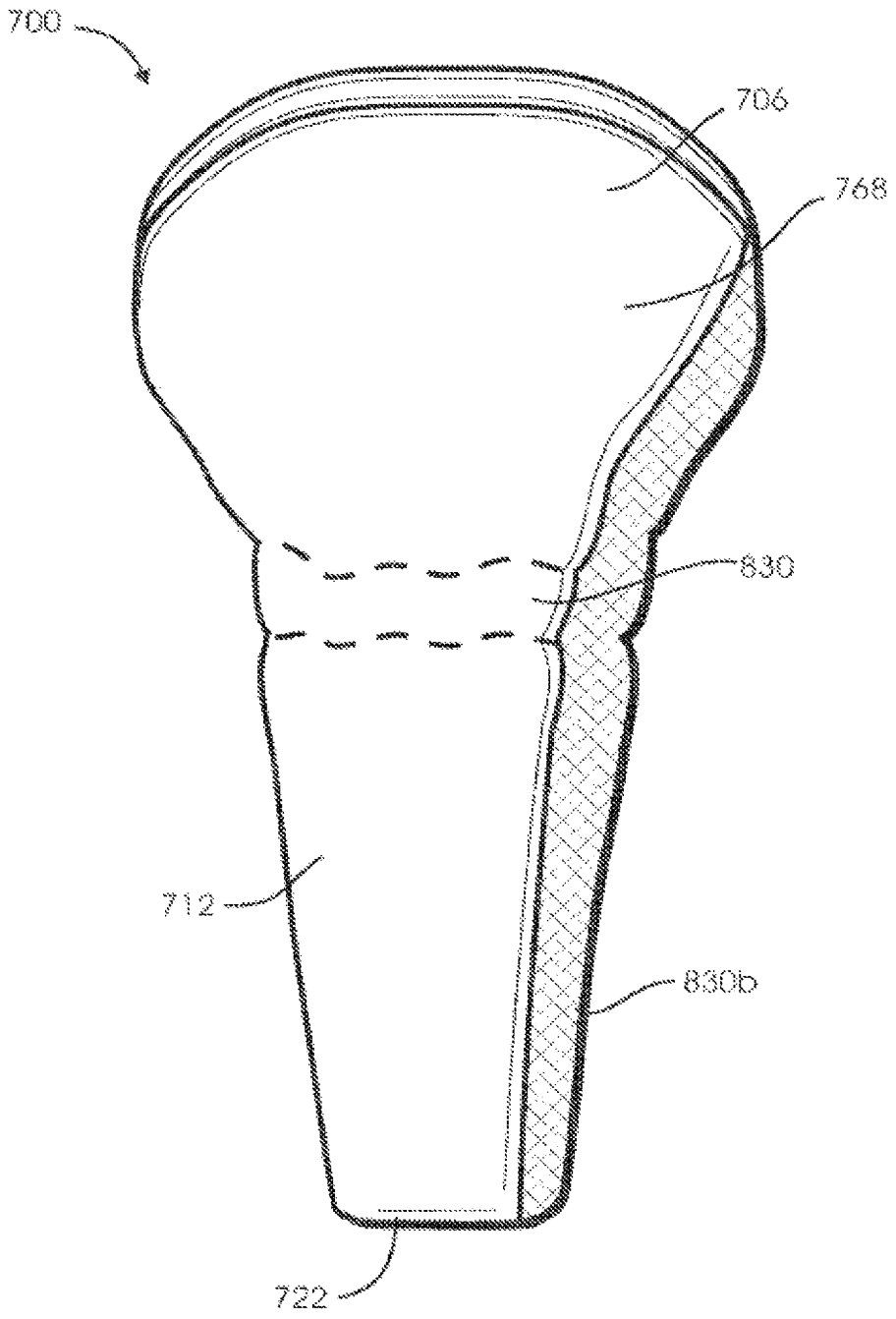
FIG. 15*a* is a bottom view of a golf club head cover according to another embodiment of the invention.
Figure 15B:
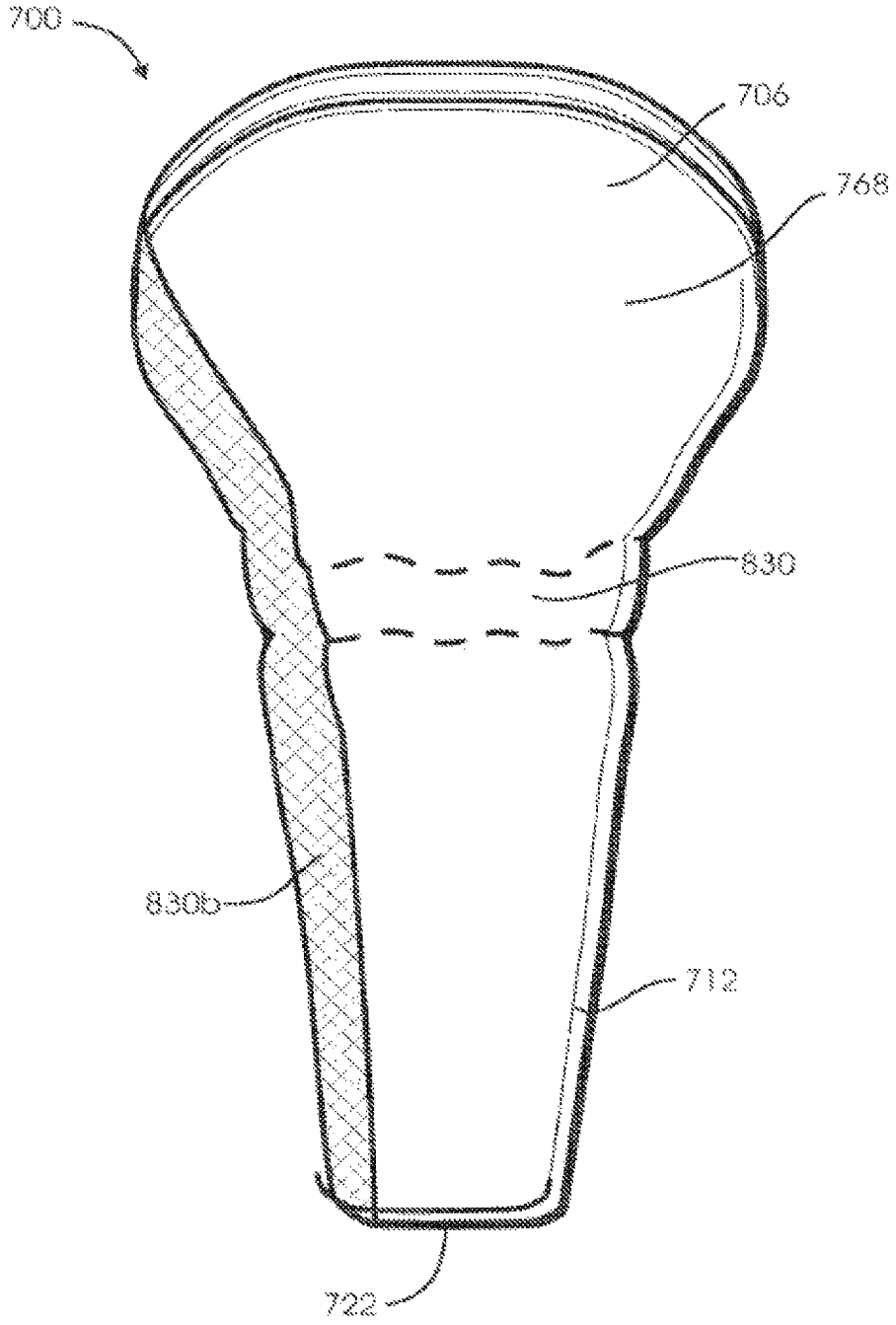
FIG. 15*b* is a bottom view of a golf club head cover according to another embodiment of the invention.

Other exemplary head covers 700 is illustrated in FIGS. 15*a*. The golf club head covers 700 of FIGS. 15*a* and 15*b* are similar to the golf club head cover 100 of FIGS. 1-11. Therefore, like structure will be identified by like reference numbers plus "600" and only the differences will be discussed hereafter.

The golf club head covers 700 include an elastic member or panel 820*a*, 820*b* that extends between the top surface 754 and the bottom surface 768 (only the bottom surface 768 is shown) on only one side of the golf club head cover 700. Additionally, although the illustrated elastic members 820*a*, 820*b* make up a portion of both the head portion 706 and the sleeve portion 712 in FIGS. 15*a*, 15*b*, in other embodiments, the elastic members 820*a*, 820*b* may extend only along the length of the sleeve portion 712 as discussed above with respect to FIGS. 1-11. The top and bottom surfaces 750, 768 are constructed from the first material and the elastic members 820*a*, 820*b* are constructed from the second material discussed above with respect to FIGS. 1-11. Accordingly, both the sleeve portion 712 or the head portion 706 and the sleeve portion 712 may be constructed from both the first material and the second material.

Referring to FIGS. 21-24, in some embodiments, the head cover 100 can include the auxiliary handle 250 as described above, and be devoid of the first handle 200 or pocket. Further, the open end 122 of the head cover 100 can be substantially larger than the open end of current head covers, thereby allowing easier positioning of the head cover 100 over the golf club head 14. In the embodiment of FIGS. 21-24, the width $W_b$ is at the narrowest point near the narrowed region 230 of the head cover 100 and increases toward the open end 122. Further, the narrowed region 230 of the head cover 100 can include elastic stitching 234, 238, as described above, to facilitate expansion when positioning the head cover 100 over the club head 14, and contraction when the head cover 100 is positioned over the club head 14, thereby provisionally securing the head cover 100 in place.

Further referring to FIGS. 21-24, in these or other embodiments, positioning of the head cover 100 over the club head 14 can be simplified due to the large opening at the open end 122 of the club head, the narrowed region 230 having the elastic stitching 234, 238, and/or the auxiliary handle 250. For example, to position the head cover 100 over the club head 14, the user can exert a force on the auxiliary handle 250 in the direction of the shaft 18. Further, in these or other embodiments, removing the head cover 100 from the club head 14 can be simplified due to the large opening at the open end 122 of the club head and/or the narrowed region 230 having the elastic stitching 234, 238. For example, to remove the head cover 100, the user can exert a force on the body 104 of the head cover 100 away from the club head 14.

Figure 20:
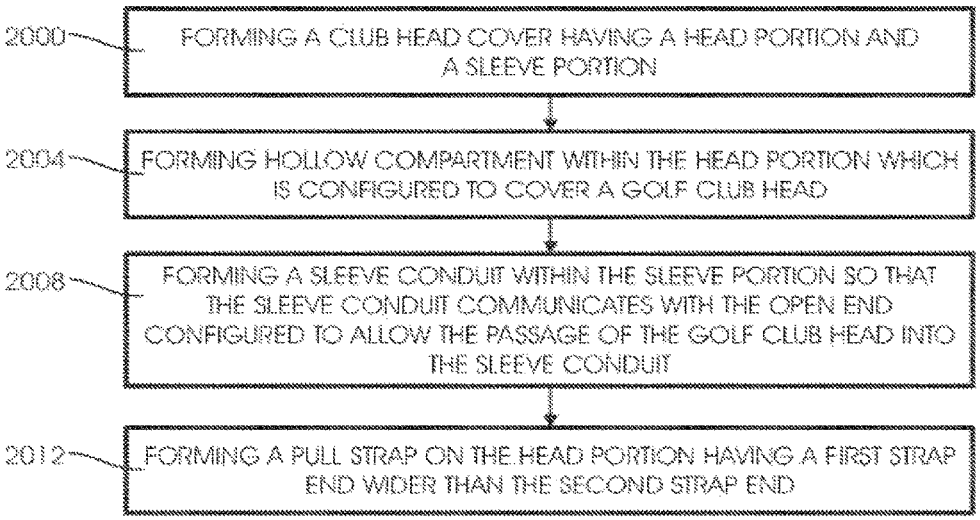
FIG. 20 is a flow chart illustrating a method for manufacturing the golf club covers of FIGS. 1-19.

Referring to FIG. 20, a flow chart illustrates one method for manufacturing the club head cover 100. At block 2000, the club head cover 100 is formed having the head portion 106 and the sleeve portion 112. As discussed above, the club head cover 100 may be formed from at least one of leather, neoprene, polyethylene, polyurethane, synthetic rubber, acrylonitrile butadiene styrene (ABS), plastic, or fabric material. At block 2004, the compartment 108 is formed within the head portion 106 which is configured to cover the golf club head 14. In embodiment of FIGS. 1-11, the hollow compartment 108 is wider at or proximate to the distal end 182 than at an end at or proximate to an opposite end 183 of the distal end 182. At block 2008, the sleeve conduit 118 is formed within the sleeve portion 112 so that the sleeve conduit 118 communicates with the open end 122 configured to allow the passage of the golf club head 14 into the sleeve conduit 118. At block 2012, the handle 200 is formed on top surface 150 of the head portion 106.

Although FIGS. 1-20 illustrate club head covers 100, 300, 500, and 700 having a particular symmetrical configuration, the apparatus and methods described herein may include other symmetrical or asymmetrical configurations. For example, the club head covers 100, 300, 500, and 700 may have a circular configuration from the top view. In another example, the club head covers 100, 300, 500, and 700 may have a more amorphous shape that "form fits" the golf club head. Similarly, the handle 200 may have any of the configurations illustrated and described herein.

Various features and advantages of the invention are set forth in the following claims.

What is claimed is:

1. A golf club head cover comprising: a body including a head portion defining a compartment that receives a golf club head; wherein the body has a top surface and a bottom surface, and a sleeve portion extending from the head portion and defining a sleeve conduit having an open end, the sleeve conduit being in communication with the compartment, the open end being positioned opposite the compartment, the sleeve portion being constructed from a first material and a second material, the second material being more elastic than the first material;

wherein the sleeve portion further comprises a top surface and a bottom surface that are constructed from the first material, and a first side member and a second side member that extend between and are coupled to the top and the bottom surfaces, wherein the first side member and the second side member are constructed of the second material;

wherein the compartment is selectively expandable and the sleeve portion is selectively expandable, the sleeve portion being expandable independently of the compartment;

wherein the sleeve portion and the compartment define a passageway that is configured to receive a golf club head therethrough, the passageway further comprising a narrowed region that is configured to selectively expand the passageway, wherein the narrowed region comprises at least a first elastic stitch and a second elastic stitch on a bottom surface of the narrowed region, wherein the first elastic stitch and the second elastic stitch are each transverse to the sleeve portion second material, and wherein the first elastic stich is above the second elastic stich, and wherein the first side member and the second side member each have an bottom end proximate to the open end of the sleeve conduit, and an upper end proximate to a lower portion of the compartment, and wherein the upper end of the first side member and the upper end of the second side member terminate at or below a line defined by the first elastic stitch, and the first elastic stitch and the second elastic stitch are each located proximate to the sleeve portion bottom surface, wherein the first and second elastic stitch cause the bottom surface to gather in the narrowed region, and wherein the upper surface of the sleeve portion is free from any elastic stitch.

2. The golf club head cover of claim 1, wherein the compartment is constructed from the first material.

3. The golf club head cover of claim 1, wherein the open end is substantially rectangularly-shaped or substantially ovular.

4. The golf club head cover of claim 1, further comprising:

the top surface of the compartment having an arcuately-shaped portion extending between a first side of the compartment and a second side of the compartment; the bottom surface of the compartment having an arcuately-shaped portion extending between a first side of the compartment and a second side of the compartment, the arcuately-shaped portion of the bottom surface of the compartment coupled to the arcuately-shaped portion of the top surface of the compartment, the arcuately-shaped portion of the top surface of the compartment and the arcuately-shaped portion of the bottom surface of the compartment at least partially defining the head portion;

a first elastic member extending between a first side of the top surface of the sleeve portion and a second side of the bottom surface of the sleeve portion;

and a second elastic member extending between the second side of the top surface of the sleeve portion and the first side of the bottom surface of the sleeve portion, the first and the second elastic members defining a portion of the sleeve portion.

5. The golf club head cover of claim 4, wherein the top surface of the golf club head cover body, the bottom surface of the golf club head cover body, the first elastic member and the second elastic member define the open end.

6. The golf club head cover of claim 5, wherein the open end is substantially rectangularly-shaped.

7. The golf club head cover of claim 1 further comprising a handle coupled to the top surface, the handle formed as a pocket that has an opening that faces in a substantially downwardly-opening direction toward the open end.

8. A golf club head cover comprising:

a body including: a top surface; a bottom surface coupled to the top surface, the top surface and the bottom surface defining a compartment;

a first elastic member extending between the top surface and the bottom surface;

a second elastic member extending between the top surface and the bottom surface, the first and the second elastic members defining at least a portion of a sleeve portion, the sleeve portion in communication with the compartment and having an open end at an end opposite the compartment;

and a narrowed region coupled between the first elastic member and the second elastic member, the narrowed region configured to selectively expand the sleeve portion;

wherein the compartment is selectively expandable and the sleeve portion is selectively expandable, the sleeve portion being expandable independently of the compartment, wherein the sleeve portion and the compartment define a passageway that is configured to receive a golf club head therethrough, the passageway further comprising the narrowed region that is configured to selectively expand the passageway, wherein the narrowed region comprises at least a first elastic stitch and a second elastic stitch on a bottom surface of the narrowed region, wherein the first elastic stitch and the second elastic stitch are each transverse to the sleeve portion first elastic member and the sleeve portion second elastic member, and the first elastic stitch and the second elastic stitch are each located proximate to the sleeve portion bottom surface, and, wherein the first elastic stitch and the second elastic stitch do not extend to the top surface of the sleeve portion, wherein the first elastic stich is above the second elastic stich, and wherein the first side member and the second side member each have an bottom end proximate to the open end of the sleeve portion, and an upper end proximate to a lower portion of the compartment, and wherein the upper end of the first side member and the upper end of the second side member terminate at or below a line defined by the first elastic stitch, and wherein the upper surface of the sleeve portion top surface is free from any elastic stitch wherein the first and second elastic stitch cause the bottom surface to gather in the narrowed region.

* * * * *